US007114491B2

(12) United States Patent
Hamada et al.

(10) Patent No.: US 7,114,491 B2
(45) Date of Patent: Oct. 3, 2006

(54) FUEL SUPPLY APPARATUS AND VAPOR SEPARATOR IN OUTBOARD ENGINE

(75) Inventors: Mikio Hamada, Obu (JP); Hiroyuki Nunome, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 213 days.

(21) Appl. No.: 10/876,528

(22) Filed: Jun. 28, 2004

(65) Prior Publication Data

US 2005/0000495 A1 Jan. 6, 2005

(30) Foreign Application Priority Data

Jul. 2, 2003 (JP) ..... 2003-190424
Jun. 3, 2004 (JP) ..... 2004-166149

(51) Int. Cl.
*F02M 37/04* (2006.01)

(52) U.S. Cl. ..... 123/516

(58) Field of Classification Search ..... 123/516, 123/509, 518, 519; 137/199, 202
See application file for complete search history.

(56) References Cited

U.S. PATENT DOCUMENTS 4,856,483 A * 8/1989 Beavis et al. ..... 123/516
5,309,885 A * 5/1994 Rawlings et al. ..... 123/509
5,375,578 A * 12/1994 Kato et al. ..... 123/516
5,404,858 A * 4/1995 Kato ..... 123/516
5,555,858 A * 9/1996 Katoh ..... 123/73 SC
5,579,740 A * 12/1996 Cotton et al. ..... 123/516
5,762,050 A * 6/1998 Gonzalez ..... 123/516
5,855,197 A * 1/1999 Kato ..... 123/516
5,858,177 A * 1/1999 Morris ..... 203/26
6,679,229 B1 * 1/2004 Wada et al. ..... 123/516
2002/0174894 A1 * 11/2002 Kolb et al. ..... 137/202

FOREIGN PATENT DOCUMENTS

JP A 2001-140720 5/2001

* cited by examiner

*Primary Examiner*—Thomas Moulis
(74) *Attorney, Agent, or Firm*—Oliff & Berridge, PLC

(57) ABSTRACT

With a low-pressure pump, fuel is supplied to a vapor separator comprising an air discharge port and a ball valve for closing the air discharge port in association with a rise in fluid level of the fuel supplied to the vapor separator. When the fuel is filled into the vapor separator entirely, the ball valve acts to tightly close the vapor separator, thereby pressurizing the fuel in the vapor separator.

34 Claims, 18 Drawing Sheets

FUEL SUPPLY APPARATUS AND VAPOR SEPARATOR IN OUTBOARD ENGINE

BACKGROUND OF THE INVENTION

1. Field of the Invention

The present invention relates to a fuel supply apparatus and a vapor separator in an outboard engine provided with a fuel injection system.

2. Description of Related Art

Conventionally, an engine provided with a fuel injection system is constructed to be supplied with a predetermined amount of fuel by means of an injector placed in an intake passage and an electrically controlled fuel pump and a predetermined amount of air supplied under the control of a throttle valve. A fuel supply apparatus in an outboard engine provided with a fuel tank mounted on a ship's body needs a long pipe for fuel supply to connect the tank to the engine. A vapor separator serving as an auxiliary, tank is therefore disposed near the engine.

An example of the above fuel supply apparatus in the outboard engine is disclosed in Japanese patent unexamined publication No. 2001-140720. This fuel supply apparatus includes a fuel tank, a vapor separator, a high-pressure fuel pump for supplying fuel to an injection nozzle (an injector) of an engine intake system, and an ECM for controlling fuel injection from the injection nozzle. The fuel supply apparatus is constructed to supply fuel to a combustion part (an engine combustion chamber) together with air supplied through the throttle body. The fuel supply apparatus further includes a first fuel vapor hose connected in communication to a reservoir part which stores fuel vapor in the vapor separator, a second fuel vapor hose connected in communication to the intake passage upstream of the throttle body, and a buffer part connected in communication to the first and second fuel vapor hoses and used for buffering the flow of fuel vapor.

In the vapor separator, normally, a float 101 is provided as shown in FIG. 19. This float 101 serves to adjust an amount of fuel to be supplied from a fuel pump 102 in order to maintain a constant amount of fuel in a vapor separator 100. Accordingly, an air layer and a fuel layer are formed in the vapor separator 100. The vapor separator 100 is provided, on the air layer side, with a pipe called a vent port 103 having an open end opening into the vapor separator 100 in order to produce a pressure substantially equal to atmospheric pressure in the vapor separator 100. The other end of the vent port 103 is connected to an intake passage to return fuel vapor generated in the vapor separator 100 to the intake passage. This is because the vapor generated in the vapor separator 100 is combustible, which may cause a fire if released into the atmosphere and cause atmospheric pollution.

However, the vapor separator of the fuel supply apparatus in the outboard engine, including one disclosed in Japanese patent unexamined publication No. 2001-140720, has a disadvantage that a large amount of vapor is generated at high temperature conditions due to heat, vibration, agitation caused by supplied fuel and return fuel, and decompression and boiling of the return fuel, and the vapor would be mixed in the air layer. The vapor separator has been configured to return the generated vapor to the intake passage as mentioned above, so that an air/fuel (A/F) ratio is liable to vary according to the amount of the vapor returned to the intake passage. This would deteriorate engine performances at the high temperature conditions.

SUMMARY OF THE INVENTION

The present invention has been made in view of the above circumstances and has an object to overcome the above problems and to provide a fuel supply apparatus and a vapor separator in an outboard engine, capable of reducing the generation of vapor at high temperature conditions to stabilize an air/fuel ratio, thereby ensuring engine performances at the high temperature conditions.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a fuel supply apparatus in an outboard engine provided with a fuel injection system, for supplying fuel from a fuel tank to an injector of the outboard engine, the apparatus comprising: a low-pressure pump for sucking the fuel from the fuel tank; a vapor separator for temporarily storing therein the fuel sucked by the low-pressure pump from the fuel tank; and a fuel pump for supplying the fuel from the vapor separator to the injector of the outboard engine while pressuring the fuel; wherein the low-pressure pump is used to fill the fuel into the vapor separator entirely and pressurize the fuel filled in the vapor separator at a predetermined pressure value or more.

In the above fuel supply apparatus in an outboard engine, fuel is fed by means of the low-pressure pump from the fuel tank into the vapor separator and temporarily stored therein. Thereafter, the fuel pump is activated to supply the fuel stored in the vapor separator to the injector of the outboard engine. The low-pressure pump operates to fill the fuel into the vapor separator entirely while pressurizing the fuel filled in the vapor separator at a predetermined pressure value or more. Thus, the pressure of a predetermined value or more is exerted on the fuel in the vapor separator, which can prevent the generation of vapor in the vapor separator. Accordingly, the generation of vapor can be reduced at high temperature conditions, thereby stabilizing an air/fuel (A/F) ratio. The engine performances at the high temperature conditions can also be ensured.

According to another aspect of the present invention, there is provided a vapor separator for temporarily storing therein fuel sucked and fed by a low-pressure pump from a fuel tank, the vapor separator comprising: pressurizing means for filling the fuel into the vapor separator entirely and increasing pressure of the fuel filled in the vapor separator.

The above separator is entirely filled with fuel by the low-pressure pump. The pressurizing means acts to increase the pressure of fuel filled in the vapor separator. Thus, the pressure of a predetermined value or more is exerted on the fuel in the vapor separator, thereby preventing the generation of vapor in the vapor separator. Accordingly, the generation of vapor at the high temperature conditions can be reduced, resulting in a stabilized air/fuel (A/F) ratio to ensure the engine performances at the high temperature conditions.

Further, according to another aspect of the invention, there is provided a vapor separator which temporarily stores therein fuel sucked and fed by a low-temperature pump from a fuel tank, the vapor separator comprising: pressurizing means for filling the fuel into the vapor separator and increasing the pressure of the fuel filled in the vapor separator; a fuel pump for discharging the fuel having been pressurized by the pressurizing means while further pressurizing the fuel to supply the further pressurized fuel to an injector of an outboard engine; and a return pipe for returning return fuel from the fuel pump to a place upstream of the low-pressure pump.

In a similar manner to the above, this vapor separator is entirely filled with fuel by the low-pressure pump. The pressurizing means acts to increase the pressure of fuel filled in the vapor separator. Thus, the pressure of a predetermined value or more is exerted on the fuel in the vapor separator, thereby preventing the generation of vapor in the vapor separator. Accordingly, the generation of vapor can be prevented.

This vapor separator includes the return pipe for returning the return fuel from the fuel pump into a part upstream of the low-pressure pump. The fuel pressure on a low pressure side, i.e., between the low-pressure pump and the vapor separator (the fuel pressure in a part upstream of the vapor separator) the will not exert an influence on the fuel pressure on a high pressure side, i.e., between the vapor separator and the injector (the fuel pressure in a part downstream of the vapor separator). This makes it possible to provide a more stable air/fuel (A/F) ratio, ensuring engine performances at high temperature conditions.

Further, according to another aspect of the invention, there is provided a vapor separator which temporarily stores therein fuel sucked and fed by a low-temperature pump from a fuel tank, the vapor separator comprising: pressurizing means for filling the fuel into the vapor separator and increasing the pressure of the fuel filled in the vapor separator; a fuel pump for discharging the fuel having been pressurized by the pressurizing means while further pressurizing the fuel to supply the further pressurized fuel to an injector of an outboard engine; a fuel pressure sensor for detecting pressure of the fuel discharged from the fuel pump; and pump control means for controlling the fuel pump based on the fuel pressure detected by the fuel pressure sensor so that the pressure of the fuel discharged from the fuel pump reaches a target fuel pressure.

In a similar manner to the above, this vapor separator is entirely filled with fuel by the low-pressure pump. The pressurizing means acts to increase the pressure of fuel filled in the vapor separator. Thus, the pressure of a predetermined value or more is exerted on the fuel in the vapor separator, thereby preventing the generation of vapor in the vapor separator. Accordingly, the generation of vapor can be prevented.

In this vapor separator, the fuel pump is controlled by the pump control means based on the fuel pressure detected by the fuel pressure sensor so that the pressure of fuel (on a high pressure side) discharged from the fuel pump reaches a target fuel pressure. Accordingly, regardless of the fuel pressure on a low pressure side, the fuel pressure on the high pressure side can be regulated continuously at a constant level. As a result, the air/fuel (A/F) ratio can be more stabilized.

The fuel pump is driven by a required amount by the pump control means. This makes it possible to reduce heat generation in the fuel pump, preventing a rise in temperature of the fuel in the vapor separator. Therefore, the generation of vapor in the vapor separator can be prevented. Because the fuel pump is driven by the required amount by the pump control means, furthermore, a reduction in power consumption of the fuel pump can be achieved.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of an engine system of an outboard engine including a fuel supply apparatus and a vapor separator embodying the present invention, will now be given referring to the accompanying drawings.

Figure 1:
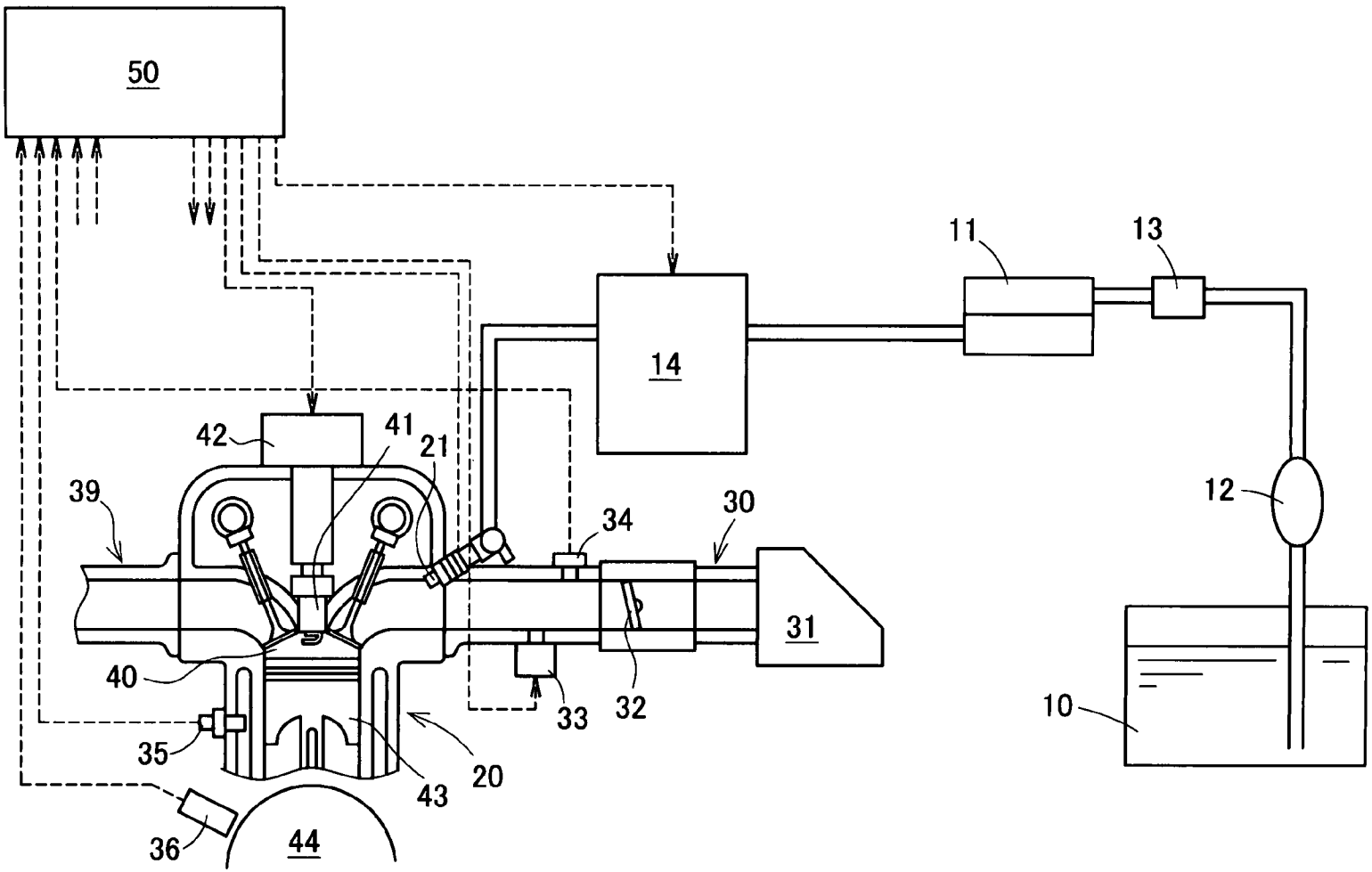
FIG. 1 is a schematic structural view of an engine system in a preferred embodiment.

FIG. 1 is a schematic structural view of the engine system of the outboard engine in the present embodiment. This engine system includes a fuel tank 10 which therein stores fuel, a low-pressure pump 11 for sucking in the fuel from the fuel tank 10, and a priming pump 12 and a fuel filter 13 disposed between the fuel tank 10 and the low-pressure pump 11. Further, the engine system further includes a vapor separator 14 for temporarily storing the fuel fed therein from the low-pressure pump 11.

A reciprocating engine 20, which is an internal combustion engine, is provided with a fuel injecting valve (an injector) 21 which is supplied with fuel from the vapor separator 14. The supplied fuel is injected into an intake passage 30 by activation of the injector 21.

The intake passage 30 is constructed to take in air through a silencer 31 from the outside. In the intake passage 30, a throttle valve 32 is placed, which is operated by a predetermined accelerator device (not shown). This throttle valve 32 is opened and closed to adjust an amount (an intake amount) of air to be sucked from the intake passage 30 into a combustion chamber 40. Furthermore, an idle speed control valve (ISC valve) 33 and an intake pressure sensor 34 are attached to the intake passage 30. The ISC valve 33 is operated to control an idle rotational speed of the engine 20 during an idle engine operation, i.e., in a full closed state of the throttle valve 32.

Various sensor 34, 35, and 36 are attached to the engine 20 to detect various operating parameters about an operating condition of the engine 20. These sensors 34 to 36 are individually connected to an ECU 50. To be more specific, the intake pressure sensor 34 provided in the intake passage 30 detects the intake pressure 'pm' in the intake passage 30 downstream of the throttle valve 32 and outputs an electrical signal representing a detected value. The water temperature sensor 35 provided in the engine 20 detects the temperature 'THW' of cooling water flowing through the inside of the engine 20 and outputs an electrical signal representing a detected value. The rotational speed sensor 36 provided in the engine 20 detects the rotational speed 'NE' of a crank shaft 44 and outputs an electrical signal representing a detected value, and simultaneously detects a TDC signal.

The engine 20 is also provided with an ECU 50 which executes various controls of the engine 20. In general, this ECU 50 is supplied with electric power from a battery used as a power source of a ship's body. In some cases, the ECU 50 is supplied with electric power directly from an electric generator attached to the engine. The signals outputted from the aforementioned sensors 34 to 36 are individually inputted to the ECU 50. Upon receipt of each signal, the ECU 50 activates the injector 21, the ISC valve 33, the ignition coil 42, and a high-pressure fuel pump 71 mentioned later, etc. in order to execute an intake pressure detection control, a fuel injection control, an ignition timing control, and other controls.

As well known, the ECU 50 includes a central processing unit (CPU), a read only memory (ROM), a random access memory (RAM), a backup RAM, an external input circuit and an external output circuit, and others. In the ECU 50, the CPU, ROM, RAM, and backup RAM are connected to the external input circuit and the external output circuit through a bus to form an arithmetic-logic circuit. The ROM has stored in advance predetermined control programs on various controls of the engine 20. The RAM temporarily stores calculation results calculated by the CPU. The backup RAM saves the previously stored data. The CPU executes the various controls in accordance with the predetermined control programs based on the detection signals which are transmitted through the input circuit from the sensors 34 to 36.

Figure 2:
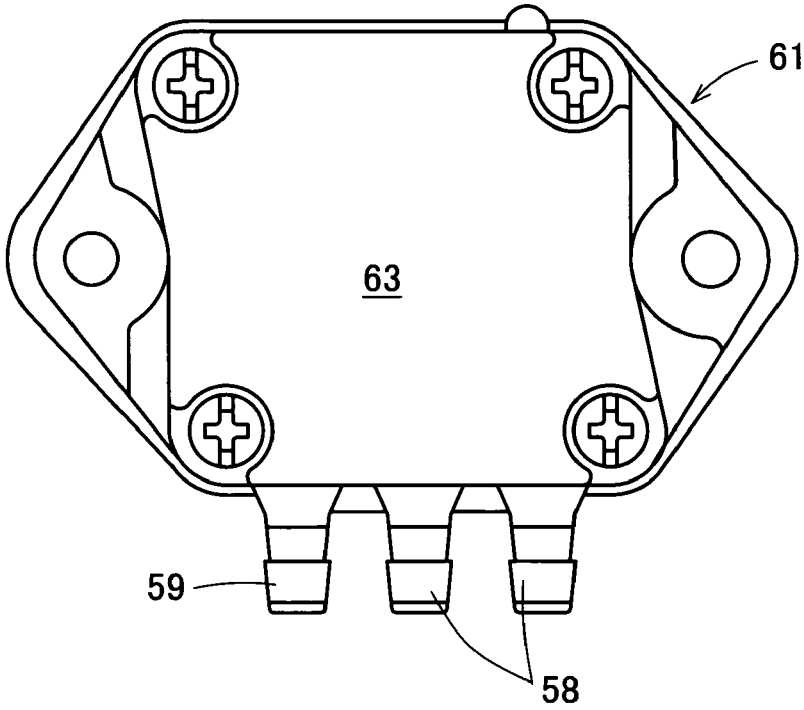
FIG. 2 is a plane view of a low-pressure pump.

Next, an explanation will be given to a fuel supply system in the aforementioned engine system. The fuel supply system is constructed to supply fuel from the fuel tank 10 to the injector 21 and includes the fuel tank 10, the low-pressure pump 11, and the vapor separator 14. At first, the low-pressure pump 11 is explained with reference to FIGS. 2 to 4. FIG. 2 is a plane view of the low-pressure pump 11, FIG. 3 is a front view of the low-pressure pump 11, and FIG. 4 is a sectional view of the low-pressure pump 11.

Figure 3:
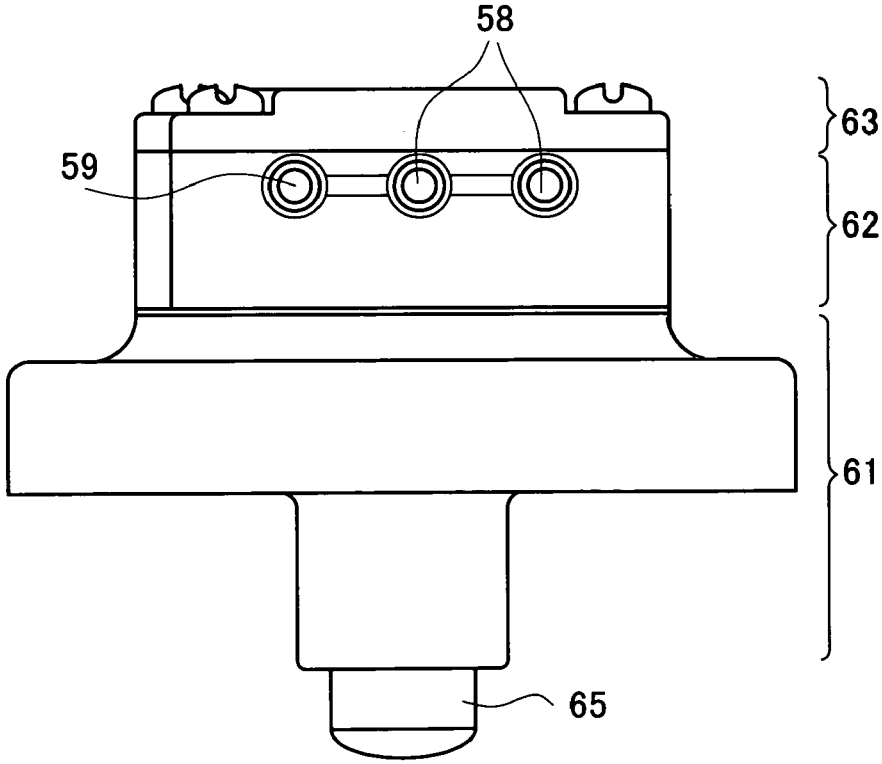
FIG. 3 is a front view of the low-pressure pump.
Figure 4:
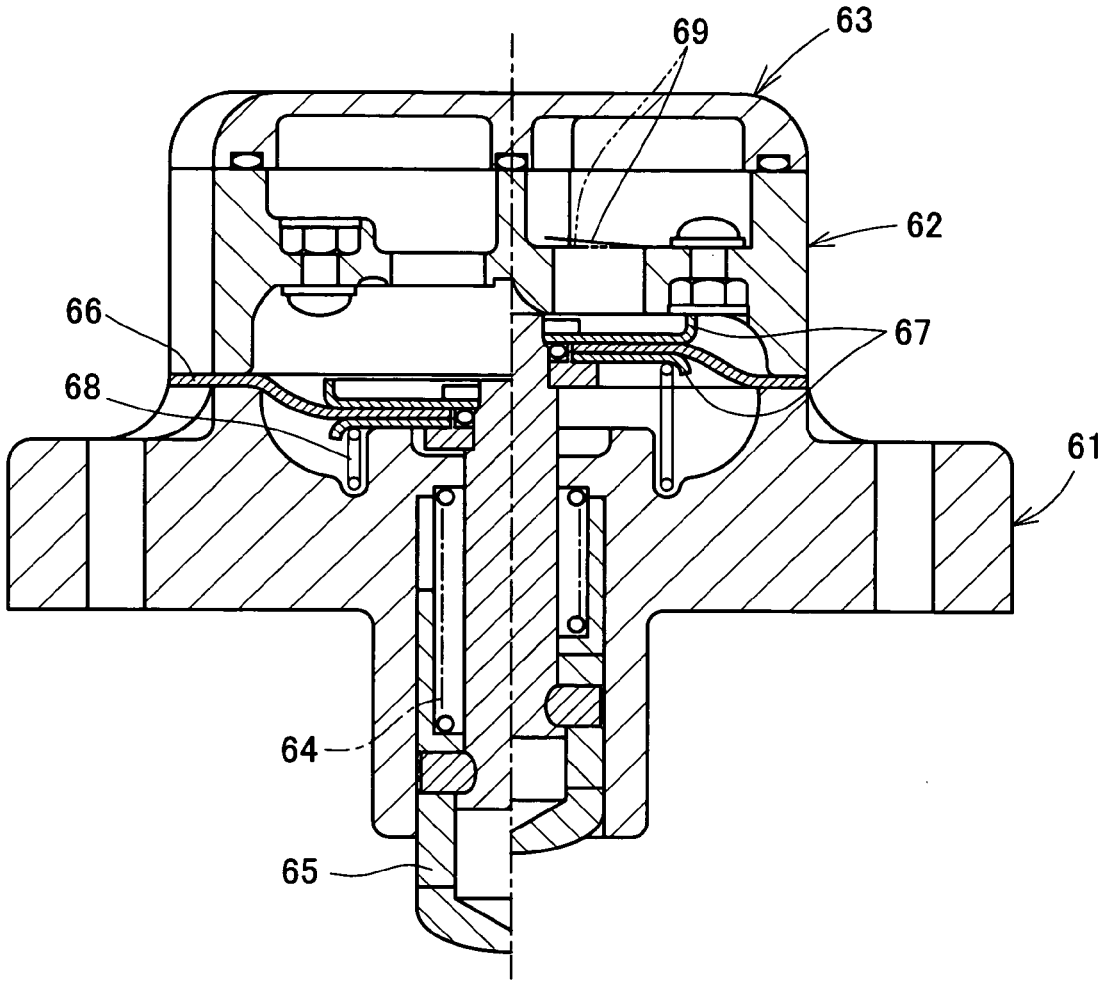
FIG. 4 is a sectional view of the low-pressure pump, showing the internal structure thereof.

The low-pressure pump 11 includes a pump base 61, a pump body 62, and a pump cover 63 as shown in FIGS. 2 and 3. The pump body 62 is formed with a suction port 59 and discharge ports 58 through which fuel is sucked in and discharged from the pump 11. This pump 11 is operated to supply fuel to the vapor separator 14. As shown in FIG. 4, the pump base 61 is centrally formed with a through hole in which a plunger 65 is movably mounted while a spring 64 urges the plunger 65 downward in FIG. 4. Sealing packing is provided on contact surfaces of the pump base 61, the pump body 62, and the pump cover 63 respectively to prevent leakage of fuel.

A pair of plates 67, including an upper and lower plates, for holding therebetween a diaphragm 66 at its center portion is fit on an upper end of the plunger 65. A spring 68 is mounted between the lower plate 67 and the pump base 61. The spring force of the spring 68 is smaller than that of the spring 64.

The peripheral edge of the diaphragm 66 is fixedly held between the pump base 61 and the pump body 62. A check valve 69 is provided above the diaphragm 66.

The low-pressure pump 11 having the above structure is operated as below. The plunger 65 is moved up and down by a dedicated cam mounted on a cam shaft for driving an engine valve. In synchronization with the motion of the plunger 65, the center portion of the diaphragm 66 is moved vertically, thereby causing opening and closing of the check valve 69 to suck and discharge fuel in and from the low-pressure pump 11. The fuel stored in the fuel tank 10 is thus fed into the vapor separator 14.

Figure 5:
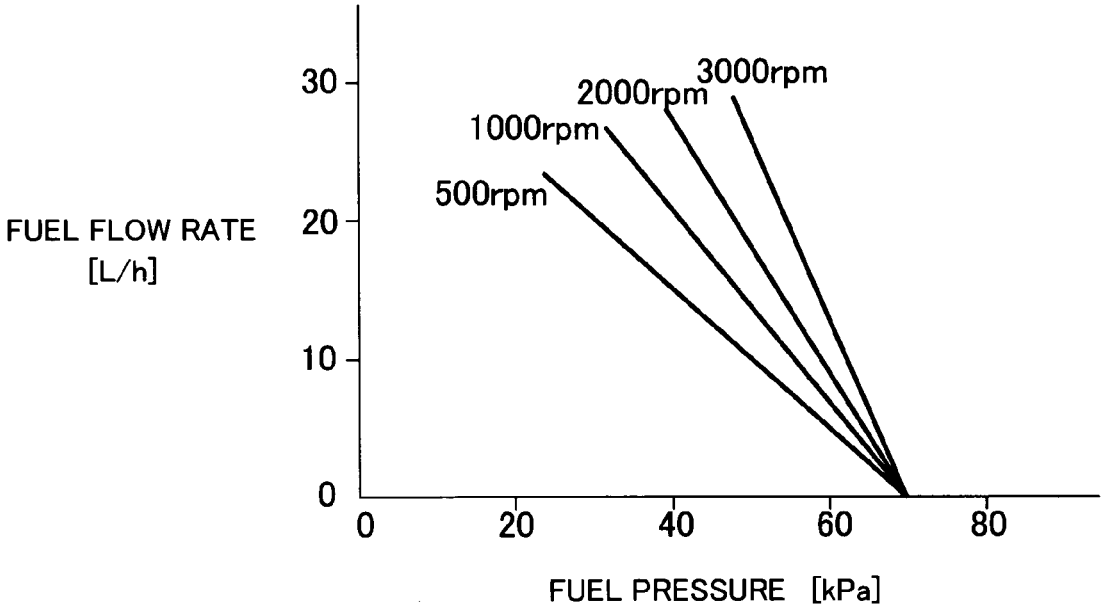
FIG. 5 is a pump characteristic graph showing performances of the low-pressure pump.

Pump characteristics of the low-pressure pump 11 are shown in FIG. 5. FIG. 5 is a graph with the horizontal axis indicating the pressure of fuel and the vertical axis indicating the flow rate of fuel to show the characteristics for each of the numbers of revolutions (rpm). It is to be noted that the discharge pressure of the low-pressure pump 11 is set at 70 kPa (in a shutoff state). The low-pressure pump 11 having the characteristics shown in FIG. 5 can provide the discharge pressure of 30 kPa or more when the flow rate is 20 L/h or less. Accordingly, the pump 11 can be used in general in outboard engines of 1000 cc or less.

Figure 6:
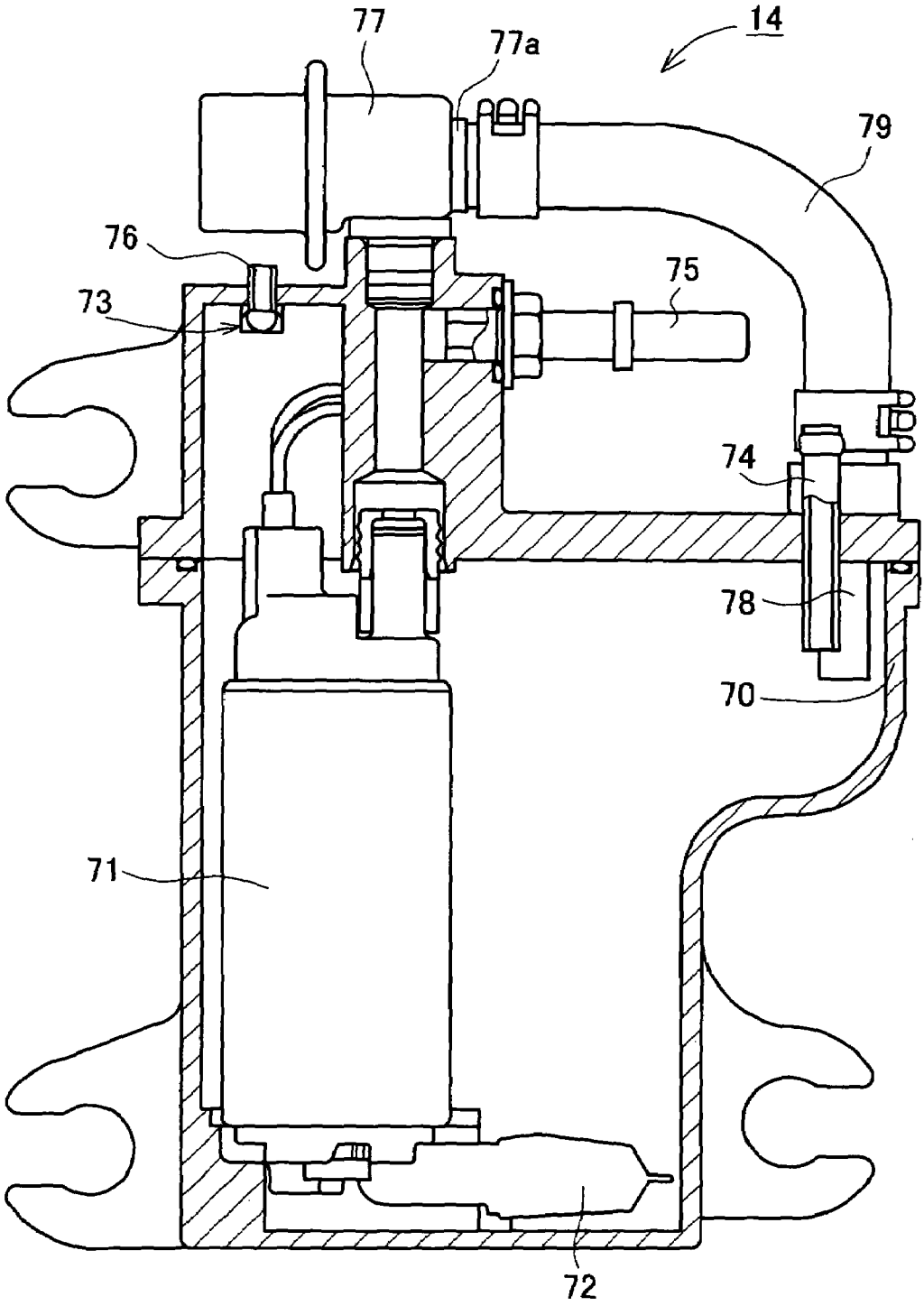
FIG. 6 is a sectional view of a vapor separator.

The vapor separator 14 is explained below with reference to FIG. 6. The vapor separator 14 serves to temporarily store the fuel fed from the fuel tank 10 by the low-pressure pump 11 and finally supply the fuel to the injector 21. This vapor separator 14 comprises, in a hollow casing 70, a high-pressure fuel pump 71, a fuel filter 72, and a ball valve 73.

The casing 70 is formed with an inlet port 74 through which low pressure fuel flows in the vapor separator 14, an outlet port 75 through which high pressure fuel flows out of the vapor separator 14, an air vent port 76 through which air is released from the casing 70 to the outside, and a return port 78 through which return fuel is returned to the casing 70. The inlet port 74 is connected to the discharge port 59 of the low-pressure pump 11 through a fuel pipe. The outlet port 75 is connected to the injector 21 through a fuel pipe. A pressure regulator 77 is attached to an outlet for the high pressure fuel (provided upstream of the outlet port 75). The return port 78 is connected to a return fuel outlet 77*a* of the pressure regulator 77 through a fuel hose 79. The vapor separator 14 is not provided with such a float as in the prior art vapor separator.

Figure 7:
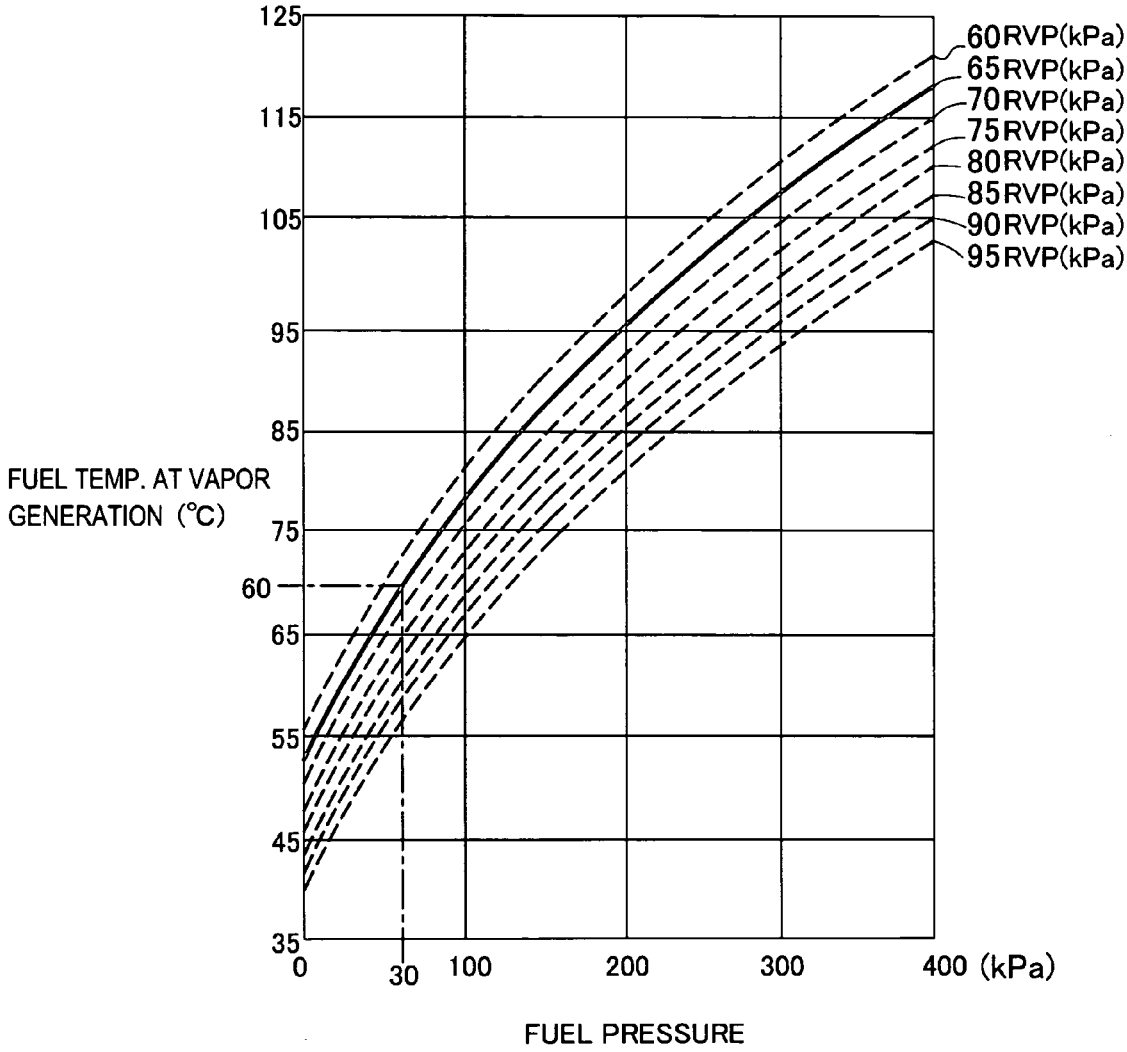
FIG. 7 is a graph showing characteristics of vapor pressure of gasoline.

As described above, the discharge pressure of the low-pressure pump 11 is always maintained at 30 kPa or more. Suppose herein that gasoline having an RVP of 65 kPa corresponding to commonly used gasoline in Japan is used. If the fuel temperature is about 60° C. (the temperature of regular fuel is about 40° C., which is increased up to about 60° C. at high temperature conditions), the fuel will not vaporize when the pressure of fuel is 30 kPa or more, as shown in the vapor pressure characteristic graph in FIG. 7. In other words, vapor will not be generated.

The operation of the engine system having the above structure is explained below. Prior to engine start, the priming pump 12 is manually operated to supply fuel from the fuel tank 10, through the fuel filter 13, into the low-pressure pump 11. When the engine 20 is started, the dedicated cam for driving the low-pressure pump 11 is rotated, causing operation of the pump 11. The fuel is thus fed by the pump 11 from the fuel tank 10 into the vapor separator 14. When the vapor separator 14 is filled with the fuel, the ball valve 73 is operated to close the air vent port 76. The pressure of fuel in the vapor separator 14 is then increased and becomes equal to the discharge pressure of the pump 11. Specifically, the fuel pressure in the vapor separator 14 becomes 30 kPa or more as mentioned above. Accordingly, no vapor will be generated in the vapor separator 14 even at high temperature conditions.

Thereafter, the fuel temporarily stored in the vapor separator 14 passes through the fuel filter 72 and is supplied by the high-pressure fuel pump 71 into the injector 21. When the injector 21 is activated, the fuel having been supplied to the injector 21 is injected into the intake passage 30. At this time, the air taken in the intake passage 30 and the fuel injected from the injector 21 are mixed to make a combustible air-fuel mixture which is sucked in the combustion chamber 40. Even at high temperature conditions, as described above, no vapor will be generated in the vapor separator 14. The air/fuel ratio of the combustible air-fuel mixture can be regulated to be constant at proper values accordingly.

An ignition plug 41 provided in the combustion chamber 40 generates sparks upon receipt of an ignition signal outputted from the ignition coil 42. The combustible air-fuel mixture sucked in the combustion chamber 40 explodes and burns by the sparking operation of the ignition plug 41. Exhaust gas resulting from the combustion is discharged from the combustion chamber 40 through an exhaust passage 39 to the outside. In association with the burning of the combustible air-fuel mixture in the combustion chamber 40, a piston 43 is moved to cause rotation of a crank shaft 44, thus producing a driving force in the engine 20. In the engine system in the present embodiment, the air/fuel ratio of the combustible air-fuel mixture can be regulated to be constant at proper values even at high temperature conditions. Consequently, the engine performances can be maintained.

The pressure regulator 77 operates based on the pressure of fuel discharged from the low-pressure pump 11 (i.e., a low-pressure pump discharge fuel pressure). Accordingly, the fuel pressure in the injector 21 becomes a value corresponding to the sum of the low-pressure pump discharge pressure and a setting pressure of the pressure regulator 77. The low-pressure pump discharge pressure is substantially constant during the shutoff state of the low-pressure pump 11, whereas at all other times it varies in response to the number of engine revolutions and the flow rate of fuel to be discharged. Specifically, the fuel pressure in the injector 21 varies in response to the number of engine revolutions (ne) and the injector energization duration (tau). Unless the fuel pressure value is corrected, accordingly, the air-fuel ratio can not be controlled at proper values.

Figure 8:
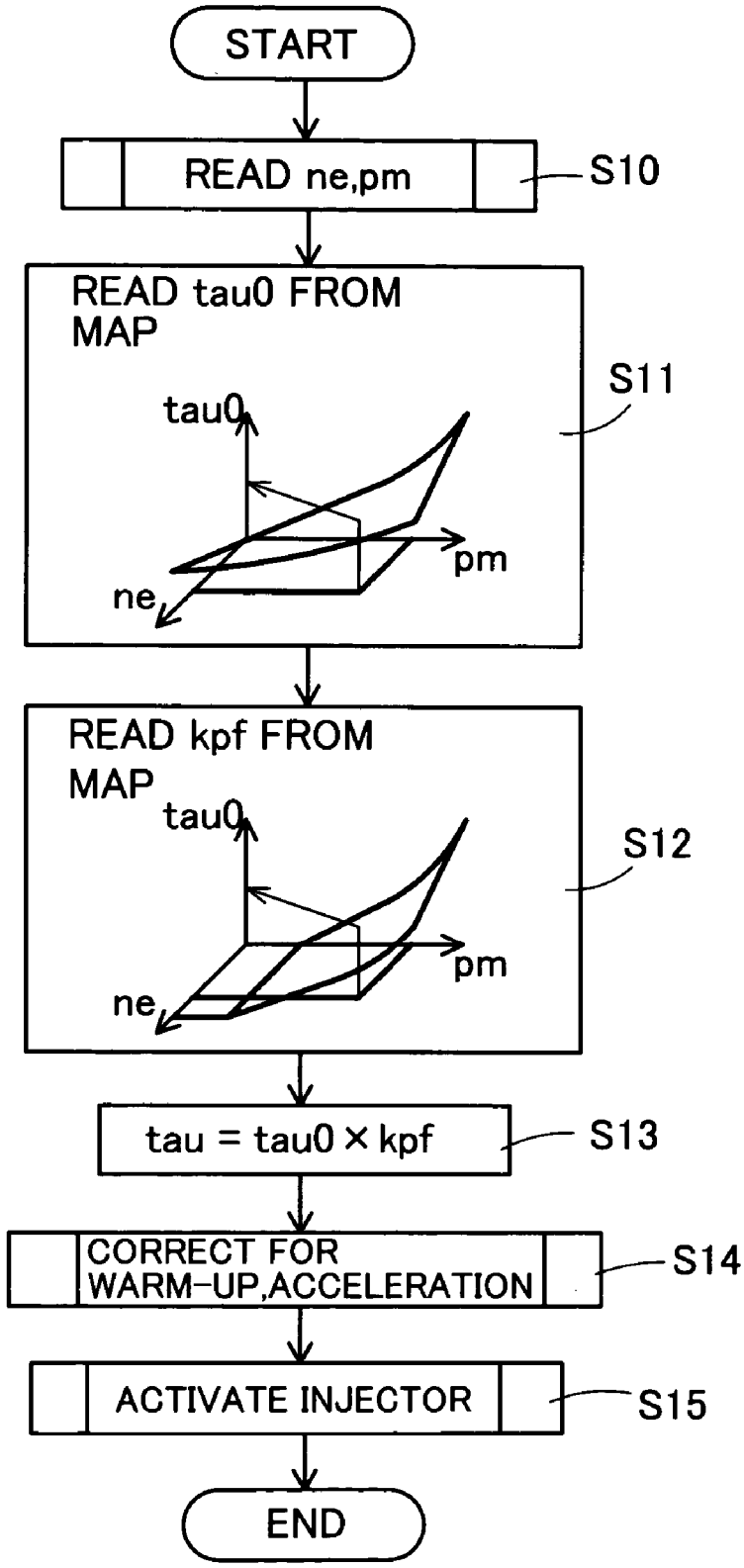
FIG. 8 is a flowchart showing a control program for correcting a fuel pressure.

Therefore the control for correcting the fuel pressure is executed in the present embodiment. The contents of the correction control are shown in a flowchart in FIG. 8. The number of engine revolutions 'ne' and the intake pressure 'pm' are first read (S10). Based on these read values 'ne' and 'pm', a basic injection duration (tau0) is determined from a map created in advance (S11). Further, a fuel pressure correction value (kpf) is also determined from another map created in advance based on the read values 'ne' and 'pm' (S12). The basic injection duration (tau0) and the fuel pressure correction value (kpf) are multiplied together to calculate an injector energization duration (tau) (S13). Then, a correction logic for warm-up, acceleration, etc. is carried out (S14), thereby activating the injector 21 (S15). In this way, the engine system in the present embodiment can control the air/fuel (A/F) ratio at proper values.

As shown in S11 and S12, the same parameters are used for determining the basic injection duration (tau0) and the fuel pressure correction value (kpf) respectively and therefore the correction value may be incorporated in the basic injection duration map.

Figure 9:
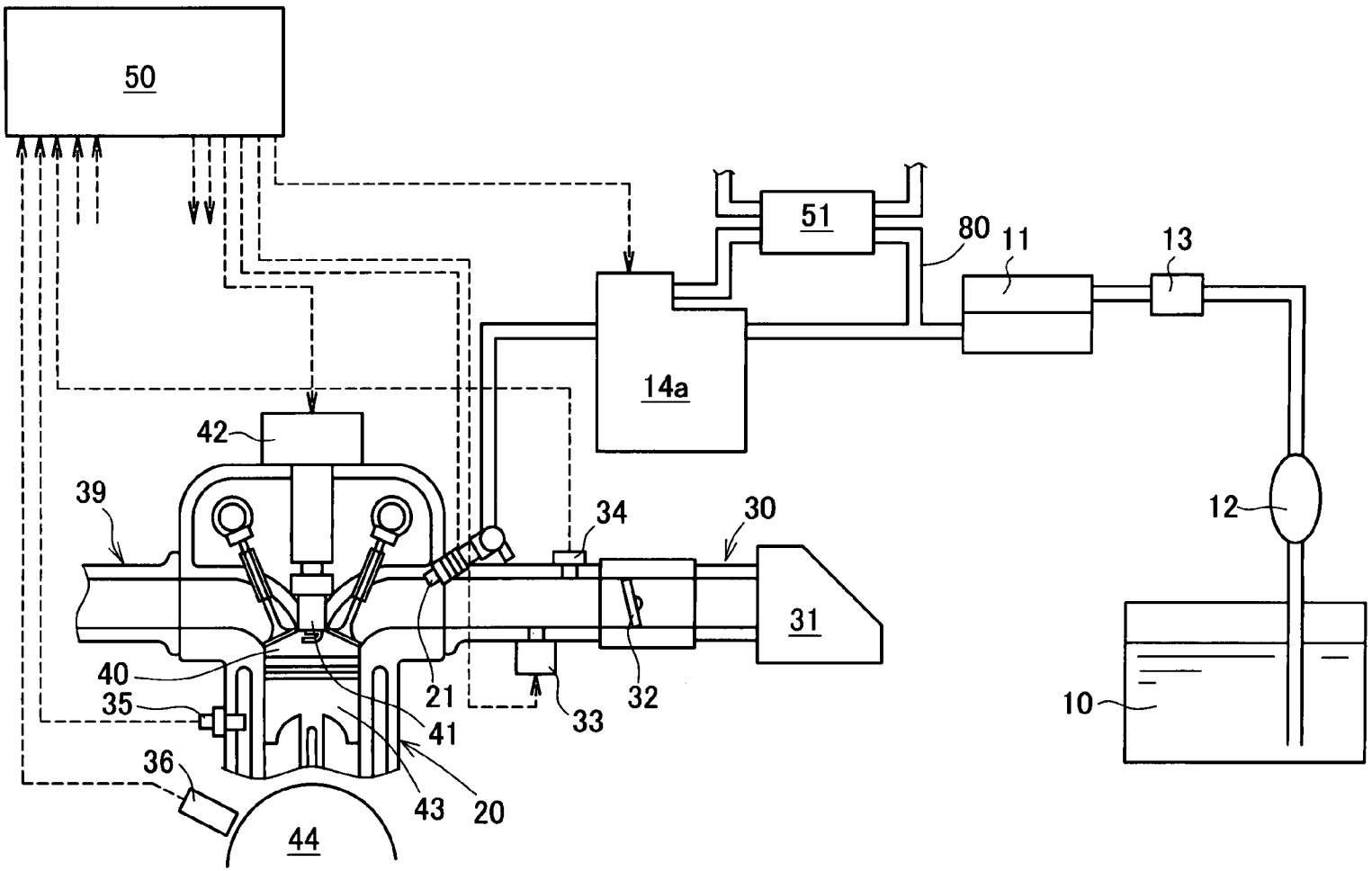
FIG. 9 is a schematic structural view of an engine system in another embodiment.
Figure 10:
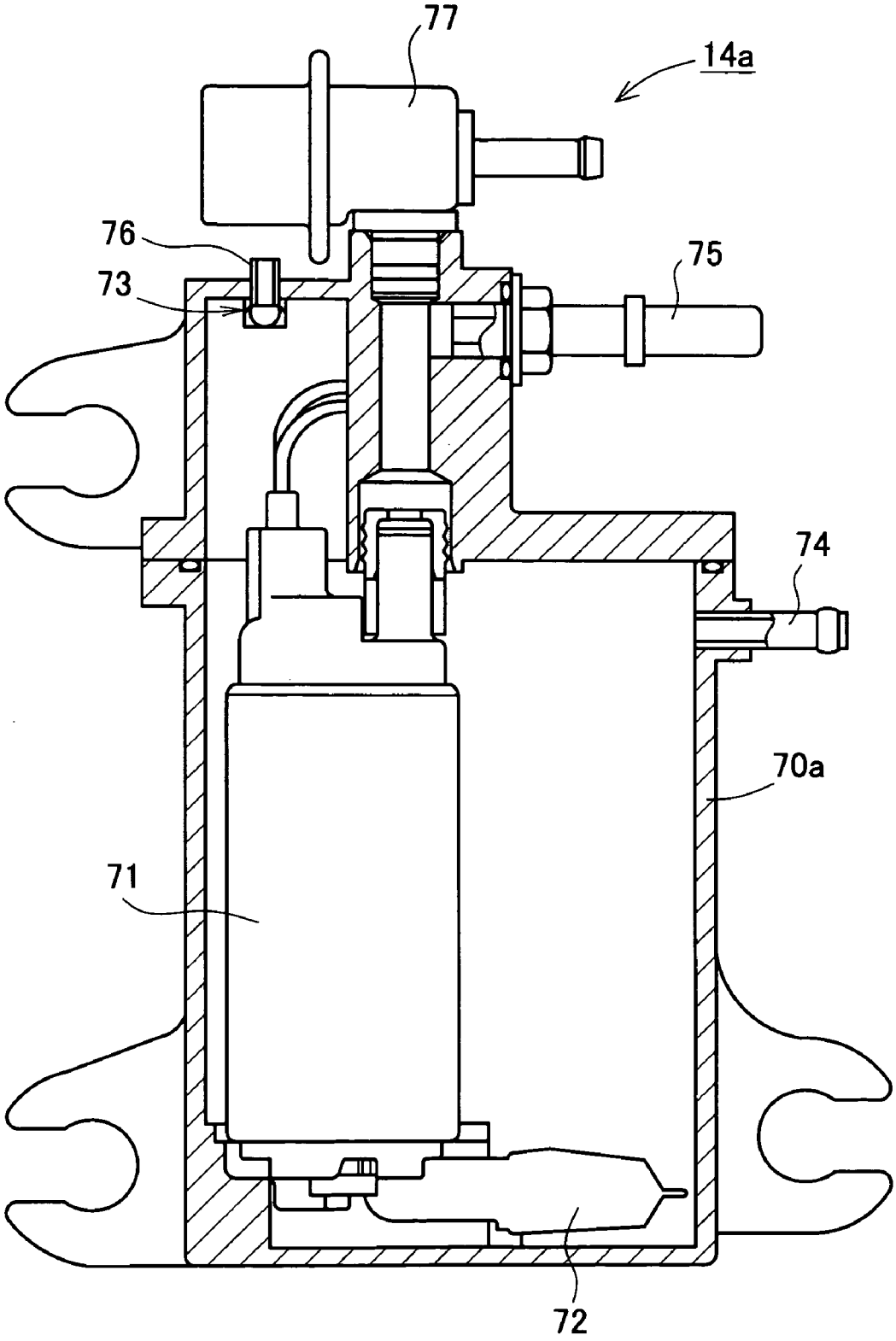
FIG. 10 is a sectional view of a vapor separator in FIG. 9.

Next, a modified form of the engine system of the outboard engine is explained. As shown in FIG. 9, this engine system is of a similar basic structure to that in the above embodiment, except that a fuel cooler 51 is provided to cool the fuel returned from a vapor separator 14*a*. Therefore no return port is provided in a casing 70*a* of the vapor separator 14*a* as shown in FIG. 10. The pressure regulator 77 is connected to the fuel cooler 51 through a return fuel pipe 80. One end of the return fuel pipe 80 is connected to a fuel pipe connecting the low-pressure pump 11 and the vapor separator 14.

The fuel cooler 51, through which cooling water circulates, serves to cool the return fuel which passes through the fuel cooler 51. The cooled return fuel is then returned to the fuel pipe connecting the low-pressure pump 11 and the vapor separator 14. In other words, the return fuel is cooled by the fuel cooler 51 and then returned to the vapor separator 14. It is to be noted that seawater may be utilized as the cooling water in the fuel cooler 51. The return fuel cooled by the fuel cooler 51 may be returned into the fuel pipe connecting the low-pressure pump 11 and the priming pump 12.

Figure 11:
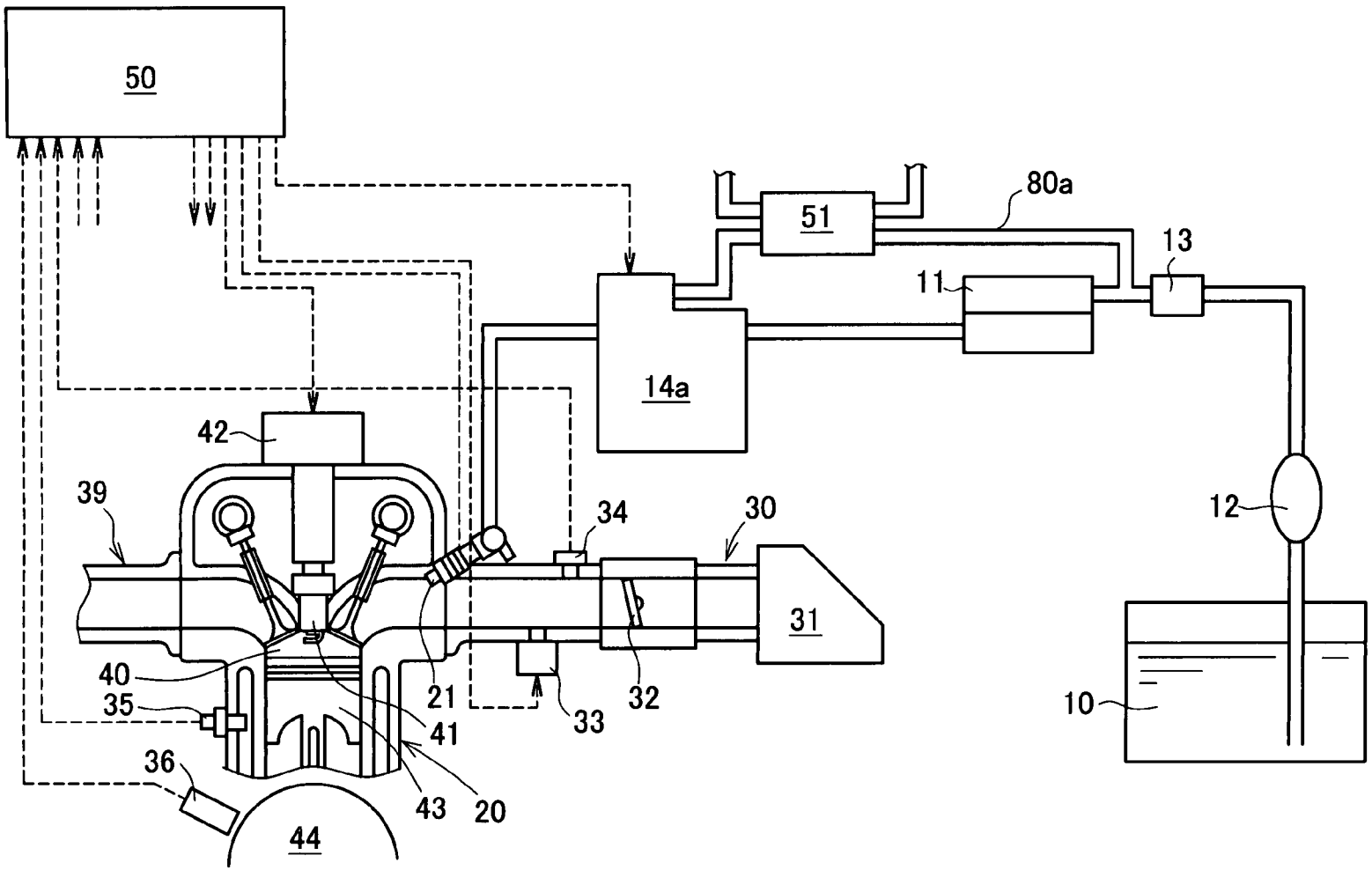
FIG. 11 is a schematic structural view of a modified form of the engine system in FIG. 9.

FIG. 11 shows another modified form of the engine system. In FIG. 11, one end of a return fuel pipe 80*a* is connected to a fuel pipe connecting the priming pump 12 and the low-pressure pump 11. Specifically, the return fuel cooled by the fuel cooler 51 may be returned into the fuel pipe connecting the priming pump 12 and the low-pressure pump 11. In this case, the fuel pressure on a low pressure side, i.e., between the low-pressure pump 11 and the vapor separator 14*a* (the fuel pressure in a fuel pipe placed upstream of the vapor separator 14*a*) will not exert an influence on the fuel pressure on a high pressure side, i.e., between the vapor separator 14*a* and the injector 21 (the fuel pressure in a fuel pipe placed downstream of the vapor separator 14*a*). This makes it possible to provide a more stable air/fuel (A/F) ratio.

Figure 12:
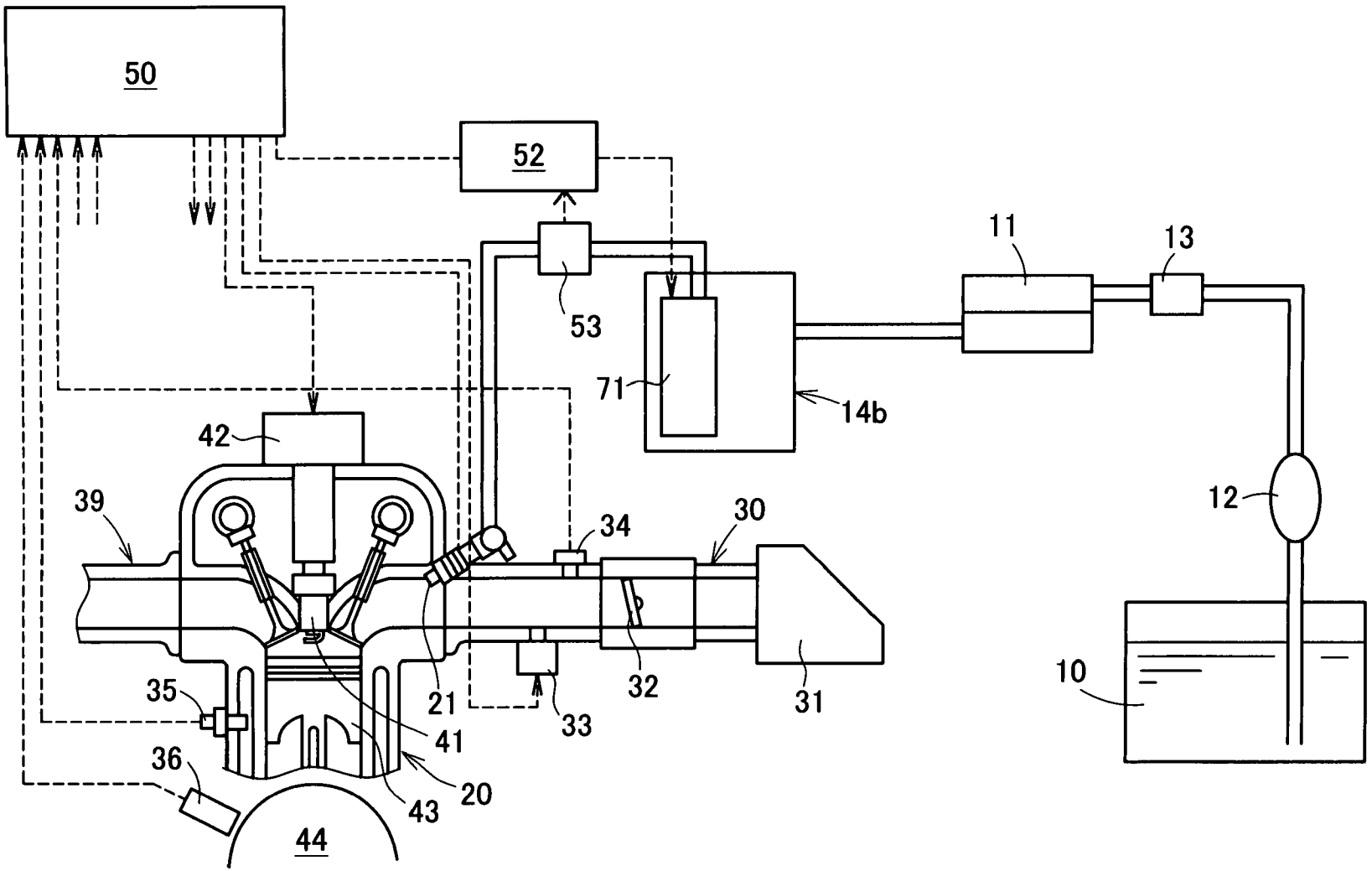
FIG. 12 is a schematic structural view of an engine system using a pump controller.

To more stabilize the air/fuel (A/F) ratio, it is important to regulate the fuel pressure on the high pressure side at a constant level. For this purpose, such an engine system shown in FIG. 12 is constructed, which includes an EFP controller 52 and a fuel pressure sensor 53 in addition to the engine system shown in FIG. 1. The fuel pressure sensor 53 is placed between the vapor separator 14*b* and the injector 21 and used to measure the fuel pressure on the high pressure side, downstream of the vapor separator 14*b*. The vapor separator 14*b* is identical in structure to the vapor separator 14 in FIG. 1 except that the vapor separator 14*b* is not provided with the pressure regulator 77 and the return port 78.

In this engine system, the pressure of fuel discharged from the high-pressure fuel pump 71 is measured by the fuel pressure sensor 53. A signal representing the fuel pressure on the high pressure side measured by the fuel pressure sensor 53 is inputted to the EFP controller 52. Based on the signal from the fuel pressure sensor 53, the EFP controller 52 controls the operation of the high-pressure fuel pump 71 so that the fuel pressure on the high pressure side reaches a target fuel pressure (about 300 kPa in the present embodiment). To be more specific, if the fuel pressure measured by the fuel pressure sensor 53 is higher than the target fuel pressure, the EFP controller 52 reduces the driving voltage to the high-pressure fuel pump 71. If the fuel pressure measured by the fuel pressure sensor 53 is lower than the target fuel pressure, on the other hand, the EFP controller 52 increases the driving voltage to the high-pressure fuel pump 71.

Accordingly, regardless of the fuel pressure on the low pressure side, the fuel pressure on the high pressure side can be regulated continuously at a constant level. This makes it possible to provide a more stable air/fuel (A/F) ratio. The high-pressure fuel pump 71 is driven by a required amount by the EFP controller 52. This makes it possible to reduce heat generation in the high-pressure fuel pump 71, preventing a rise in temperature of the fuel in the vapor separator 14*b*. Therefore, the generation of vapor in the vapor separator 14*b* can be prevented. Because the high-pressure fuel pump 71 is driven by the required amount by the EFP controller 52, furthermore, a reduction in power consumption of the high-pressure fuel pump 71 can be achieved. It is to be noted that the ECU 50 and the EFP 52 may be constructed as a single unit.

The engine system having the above EFP controller 52 may cause such problems that the fuel pressure on the high pressure side abnormally increases when the consumption of fuel rapidly decreases at the time of deceleration or the temperature of fuel increases during engine stop, and the fuel pressure on the high pressure side extraordinarily increases when the high-pressure fuel pump 71 and its control system are broken down. Further, the fuel pipe provided on the high pressure side may be disconnected from the vapor separator 14*b* when the pressure of the fuel on the high pressure side abnormally increases. It is therefore necessary to prevent those troubles from occurring.

Figure 13:
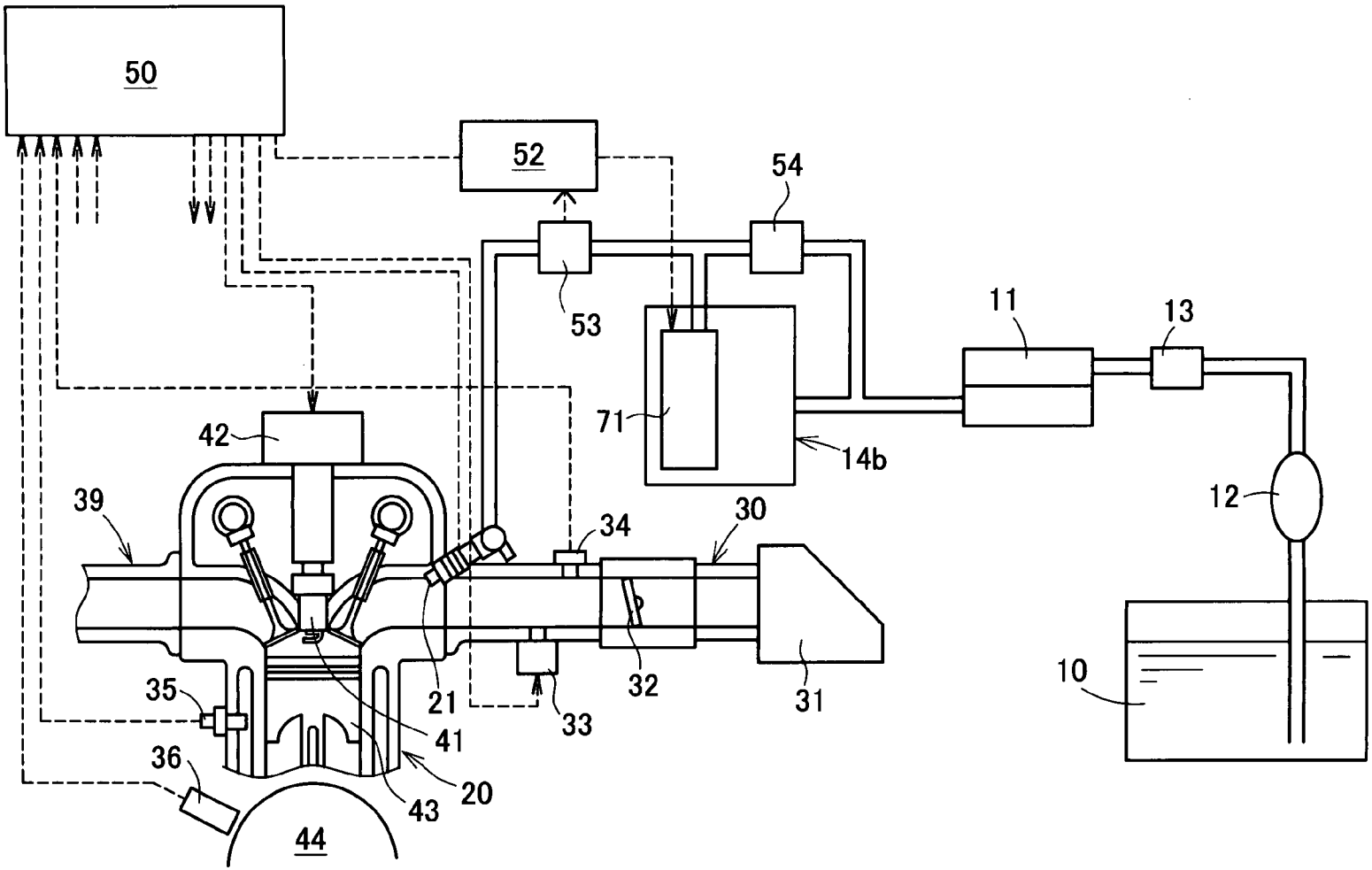
FIG. 13 is a schematic structural view of the engine system in FIG. 12.

Hence, as illustrated in FIG. 13 showing a modified form of the engine system in FIG. 12, a relief valve 54 is preferably provided between a fuel pipe on the high pressure side and a fuel pipe on the low pressure side. The relief valve 54 is constructed to open when the fuel pressure on the high pressure side reaches a predetermined value (for example, about 400 to 500 kPa). When the pressure of fuel on the high pressure side abnormally increases, therefore, the relief valve 54 is opened to reduce the fuel pressure on the high pressure side. This can surely prevent the fuel pipe on the high pressure side from becoming disconnected from a vapor separator 14*b*.

Moreover, the fuel flow rate is low while the engine runs at idle., so that a cooling effect by the fuel supplied from the low-pressure pump 11 is not good enough to prevent the generation of vapor in the vapor separator 14*b* at the high temperature conditions and the generation of vapor lock in the high-pressure fuel pump 71.

Figure 14:
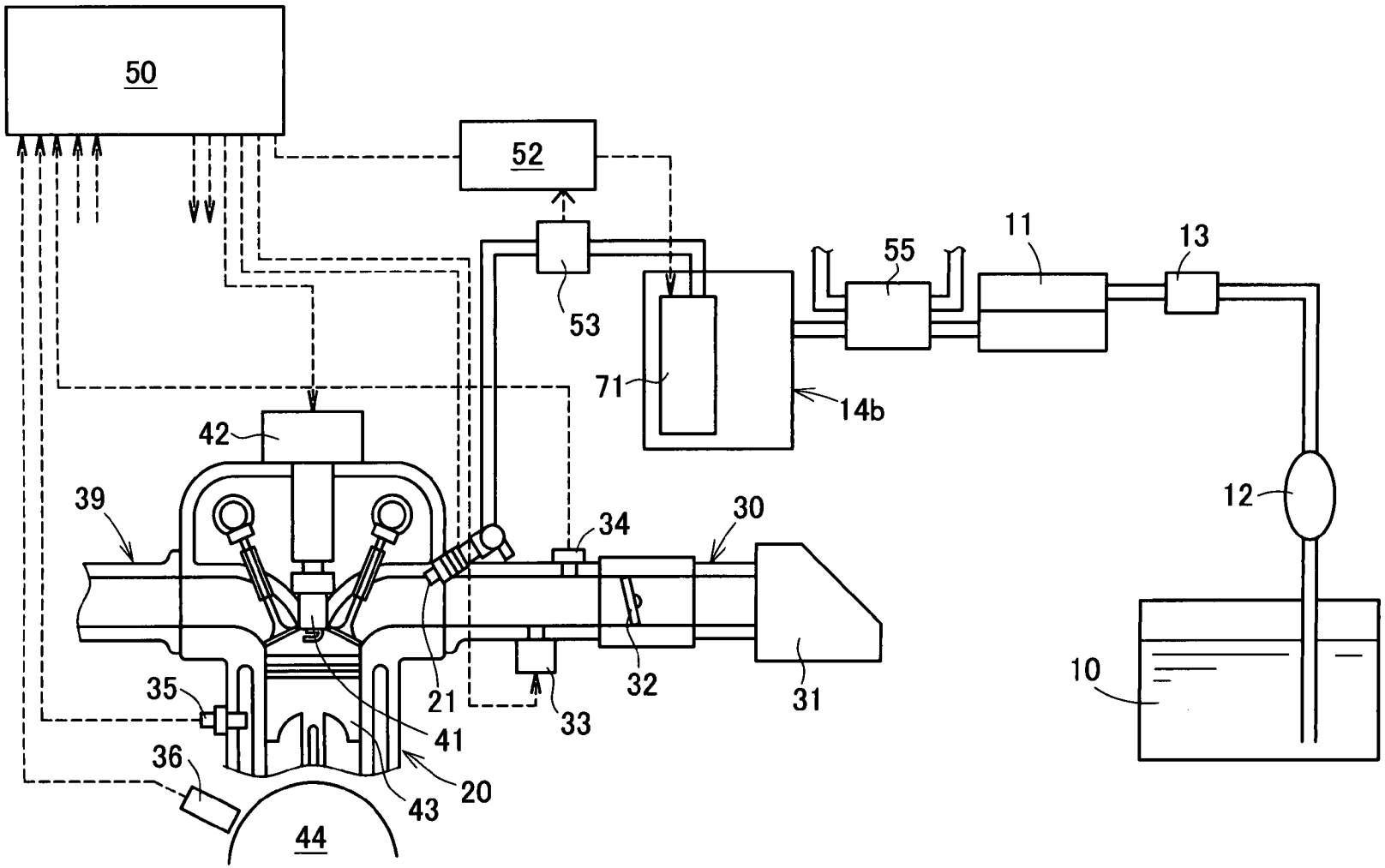
FIG. 14 is a schematic structural view of another modified form of the engine system in FIG. 12.

To prevent the above defects, as illustrated in FIG. 14 showing another modified form of the engine system in FIG. 12, a fuel cooler 55 is preferably provided between the low-pressure pump 11 and the vapor separator 14*b*. This fuel cooler 55, through which cooling water circulates, serves to cool the fuel which passes through the fuel cooler 55. The cooled fuel by the fuel cooler 55 is then supplied to the vapor separator 14*b*, thereby cooling the fuel in the vapor separator 14*b*. This makes it possible to surely prevent the generation of vapor in the vapor separator 14*b* and the generation of vapor lock in the high-pressure fuel pump 71. Seawater may be utilized as the cooling water in the fuel cooler 55.

Figure 15:
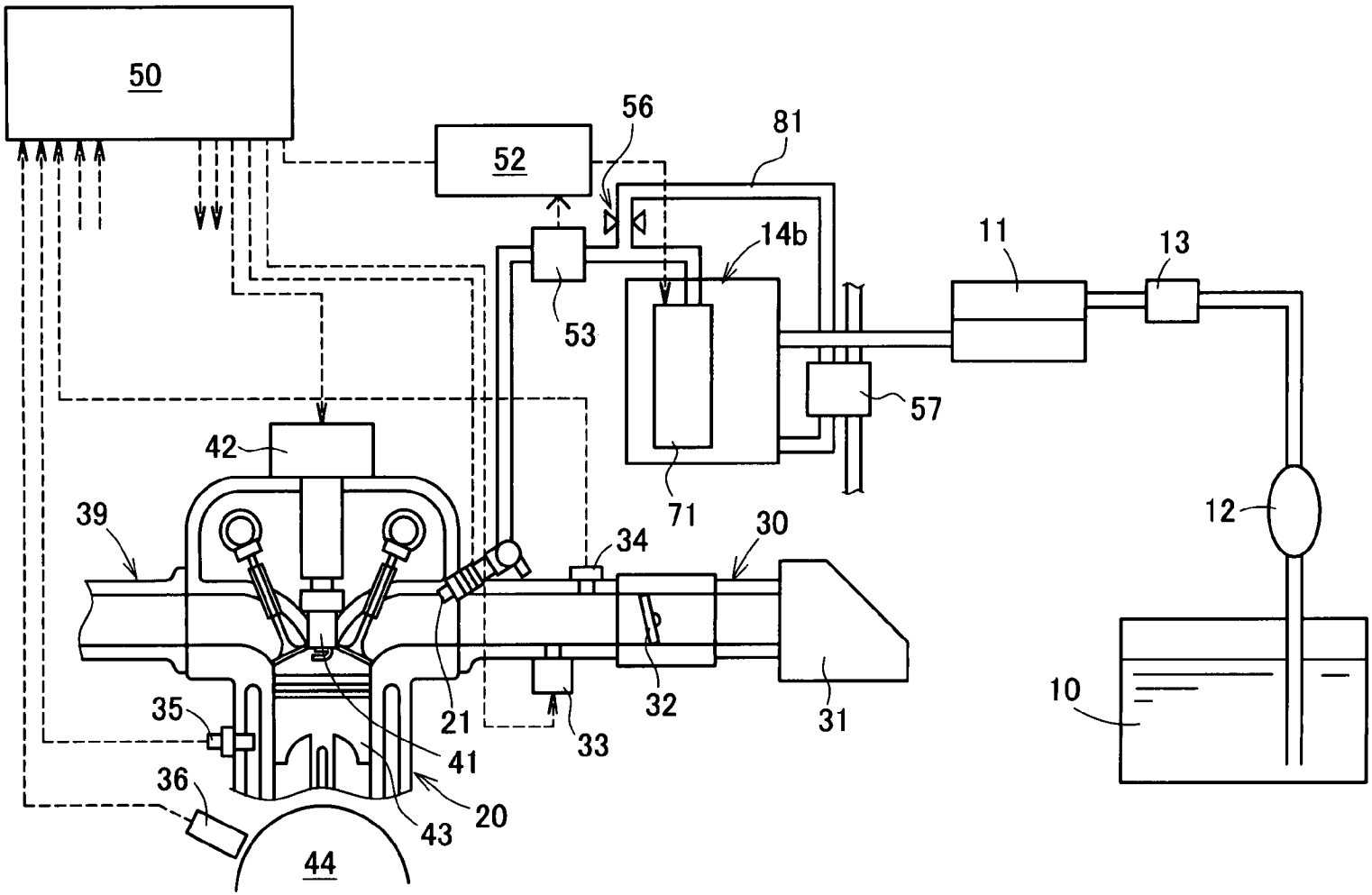
FIG. 15 is a schematic structural view of another modified form of the engine system in FIG. 12.

Moreover, as illustrated in FIG. 15 showing another modified form of the engine system in FIG. 12, preferably, a branch pipe 81 is provided branching off from a fuel pipe connecting the high-pressure fuel pump 71 and the fuel pressure sensor 53 and the branch pipe 81 is connected to the vapor separator 14*b*. In this branch pipe 81, there are placed a restriction 56 and a fuel cooler 57. With this restriction 56, the sectional area of the branch pipe 81 is reduced thereat. Part of the fuel discharged from the high-pressure pump 71 is returned as return fuel to the vapor separator 14*b*. The fuel cooler 57, through which cooling water circulates, serves to cool the return fuel which passes through the fuel cooler 57.

In the above manner, the return fuel flowing in the branch pipe 81 is cooled by the fuel cooler 57 and then returned to the vapor separator 14*b*. Accordingly, the fuel in the vapor separator 14*b* can be more cooled than in the above case where the fuel cooler 55 is used as shown in FIG. 14. It is therefore more surely possible to prevent the generation of vapor in the vapor separator 14*b* and the generation of vapor lock in the high-pressure fuel pump 71. Similarly, seawater may be utilized as the cooling water in the fuel cooler 57.

When the engine 20 is stopped, the fuel supply system is tightly closed. The fuel expands in volume at the high temperature conditions, which would extremely increase the pressure of fuel on the low pressure side (to about 300 kPa). At this moment, the fuel pipe on the low temperature side may become disconnected from the vapor separator 14*b*.

Figure 16:
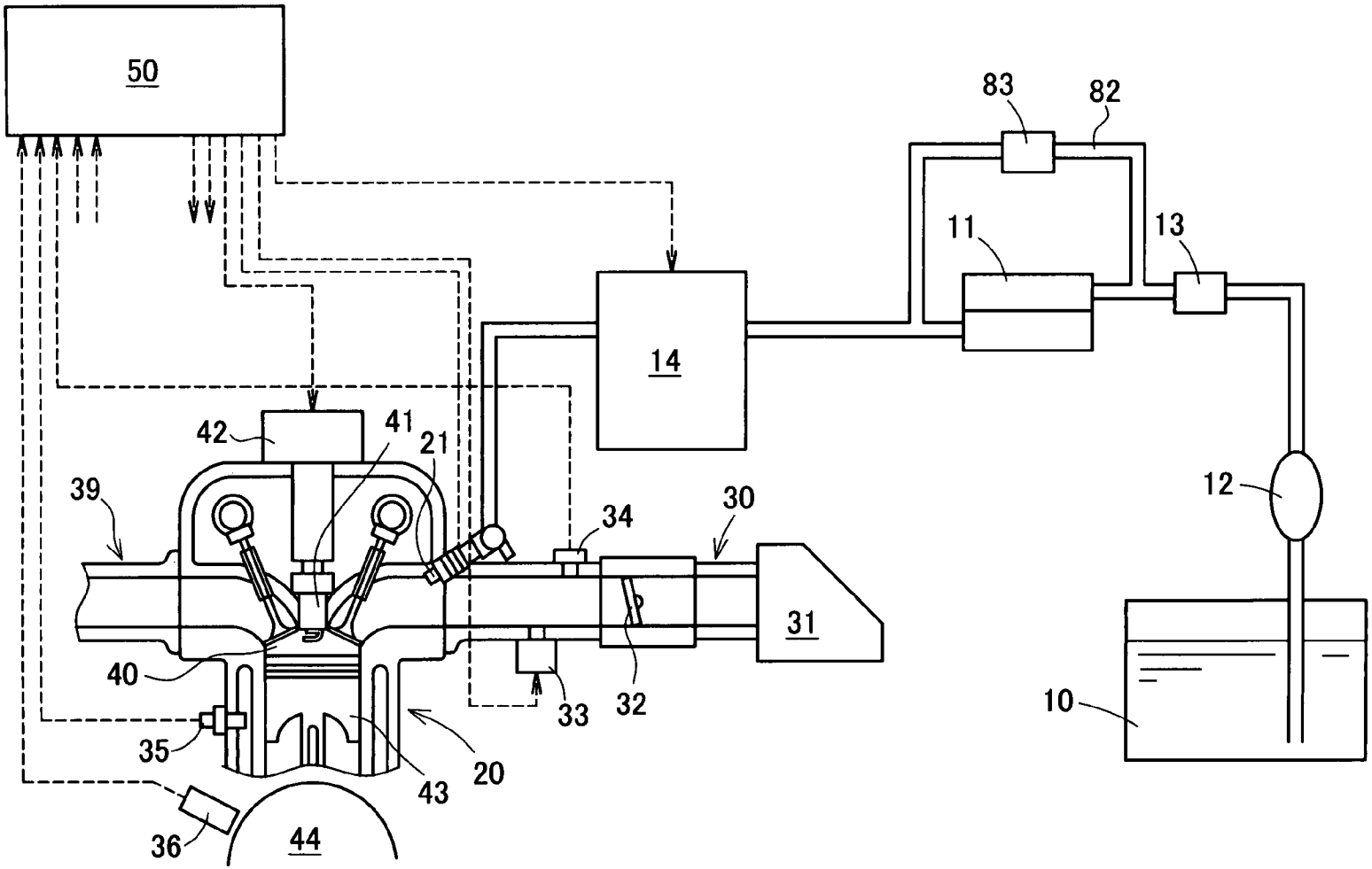
FIG. 16 is a schematic structural view of another modified form of the engine system in FIG. 1.

To prevent such a defect, as illustrated in FIG. 16 showing a modified form of the engine system in FIG. 1, a relief pipe 82 is preferably provided as a bypass detouring the low-pressure pump 11 and a relief valve 83 is placed in the relief pipe 82. This relief valve 83 is constructed to open when the pressure of fuel in the relief pipe 82 reaches a predetermined value or more (for example, about 100 kPa). If the fuel pressure on the low pressure side extremely increases, therefore, the relief valve 83 is opened and hence the fuel pressure in the fuel pipe on the low pressure side will not increase more than the valve opening pressure of the relief valve 83. Consequently, it is possible to surely prevent the fuel pipe on the low pressure side from becoming disconnected from the vapor separator 14*b*.

Figure 17:
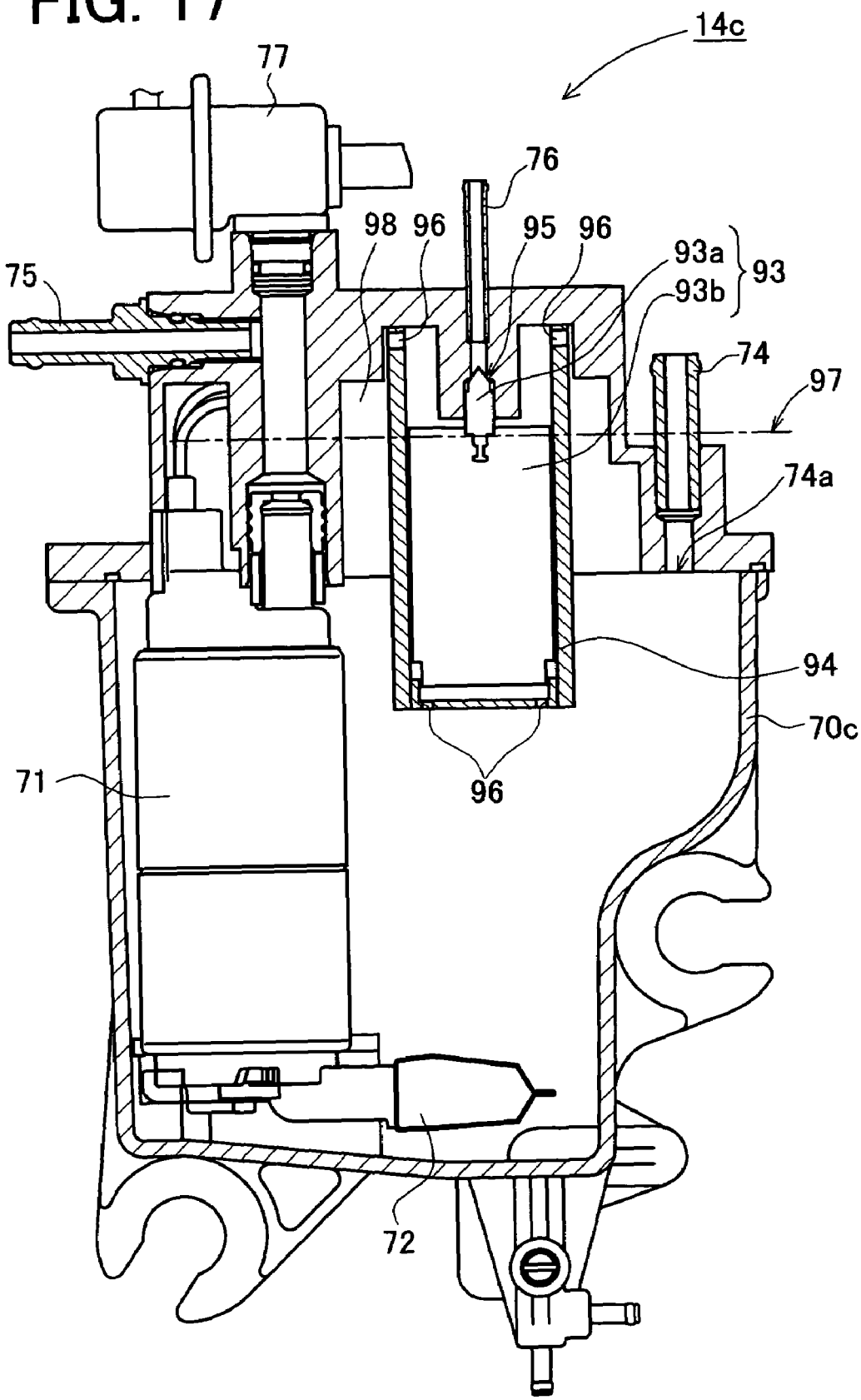
FIG. 17 is a sectional view of a modified form of the vapor separator.

Next, a modified form of the vapor separator will be explained with reference to FIG. 17. FIG. 17 is a sectional view showing a schematic structure of the vapor separator 14*c*. This vapor separator 14*c* is identical in structure to the vapor separator 14 in FIG. 1, except for the structure of a closing mechanism. The following description will therefore be given with a focus on the differences therebetween. Identical elements to those in FIG. 1 are indicated by the same reference numerals and their explanations are omitted.

The vapor separator 14*c* is provided with a high-pressure fuel pump 71, a fuel filter 72, and a float valve 93, which are housed in a casing 70*c* as shown in FIG. 17. The casing 70*c* is formed with an inlet port (pipe) 74 through which lower pressure fuel flows in the vapor separator 14*c*, an outlet port 75 through which high pressure fuel flows out of the vapor separator 14*c*, and an air vent port 76 through which air is released from the casing 70*c* to the outside. The inlet port 74 is connected to the discharge port 59 of the low-pressure pump 11 through a fuel pipe. The outlet port 75 is connected to the injector 21 through a fuel pipe. A pressure regulator 77 is attached to an outlet for the high pressure fuel (upstream of the outlet port 75).

The float valve 93 is provided with a valve element 93*a* and a cylindrical float 93*b*. This float valve 93 is required to have its own weight enough to open during a fuel shortage and further required to generate buoyant force exceeding the own weight. Thus, a larger float 93*b* would be needed. Such a larger float 93*b* is apt to be unstable in posture (i.e., the float 93*b* tilts), so that the float valve 93 is unlikely to tightly close an air discharge port 76.

To avoid the above defect, a guide member 94 is provided to prevent the float 93*b* from tilting, thereby stabilizing the posture of the float 93*b*. This guide member 94 is of a cylindrical shape having a bottom and is formed with holes 96 in the upper and bottom portions to allow air or fuel to pass therethrough. The guide 94 is also designed to have an inner diameter slightly larger than the outer diameter of the float 93*b*. This makes it possible to move the float 93*b* up and down within the guide 94 smoothly without tilting.

When the temperature of the fuel having been filled in the vapor separator increases, in general, the pressure in the vapor separator will increase (to 300 kPa or more) due to thermal expansion, which may cause disconnection of the fuel pipe from the vapor separator. In the vapor separator 14*c*, therefore, the float valve 93 is disposed so that a closed position 95 of the float valve 93 is a little lower than the uppermost part of the casing 70*c*. Accordingly, a fluid level 97 in the vapor separator 14*c* becomes lower than the uppermost part of the casing 70*c*, forming an air layer 98 in the upper area of the casing 70*c*. This air layer 98 serves to moderate the increase of pressure in the vapor separator 14*c* caused when the fuel expands with temperature, thus improving the safety. For example, when the air layer 98 of about 100 cc in volume was provided, the pressure in the vapor separator 14*c* decreased to about 140 kPa.

In the vapor separator 14*c*, further, the inlet port 74 has an open end 74*a* opening into the vapor separator 14*c* at a position lower than the closing position 95 of the float valve 93. Through the inlet port 74, that is, the open end 74*a*, the fuel discharged from the low-pressure pump 11 is allowed to flow into the fuel having been supplied previously to the vapor separator 14*c*. This makes it possible to minimize the generation of vapor foams, thereby preventing a decrease in buoyant force of the float valve 93 which might be caused due to vapor foams and air bubbles. In addition, fuel leakage can be avoided. The generation of vapor can be prevented accordingly.

In the engine system in the present embodiment explained above, the low-pressure pump 11 is operated to supply the fuel to the vapor separator 14 provided with the air vent port 76 and the ball valve 73 which closes the air vent port 76 in association with a rise in fluid level of the fuel caused by the filling of fuel in the vapor separator 14. Accordingly, the fuel can be filled in the vapor separator 14 entirely. Then, the vapor separator 14 can be closed tightly by means of the ball valve 73, thereby increasing the pressure of the fuel in the vapor separator 14. Because the discharge pressure of the low-pressure pump 11 is set at 70 kPa (in the shutoff state) and therefore the discharge pressure of 30 kPa or more can be maintained, so that the fuel in the vapor separator 14 can be pressurized constantly at 30 kPa or more. Consequently, the generation of vapor in the vapor separator 14 can surely be prevented even at high temperature conditions. It is therefore possible to make the air/fuel (A/F) ratio stable and ensure the engine performances at high temperature conditions.

Figure 18:
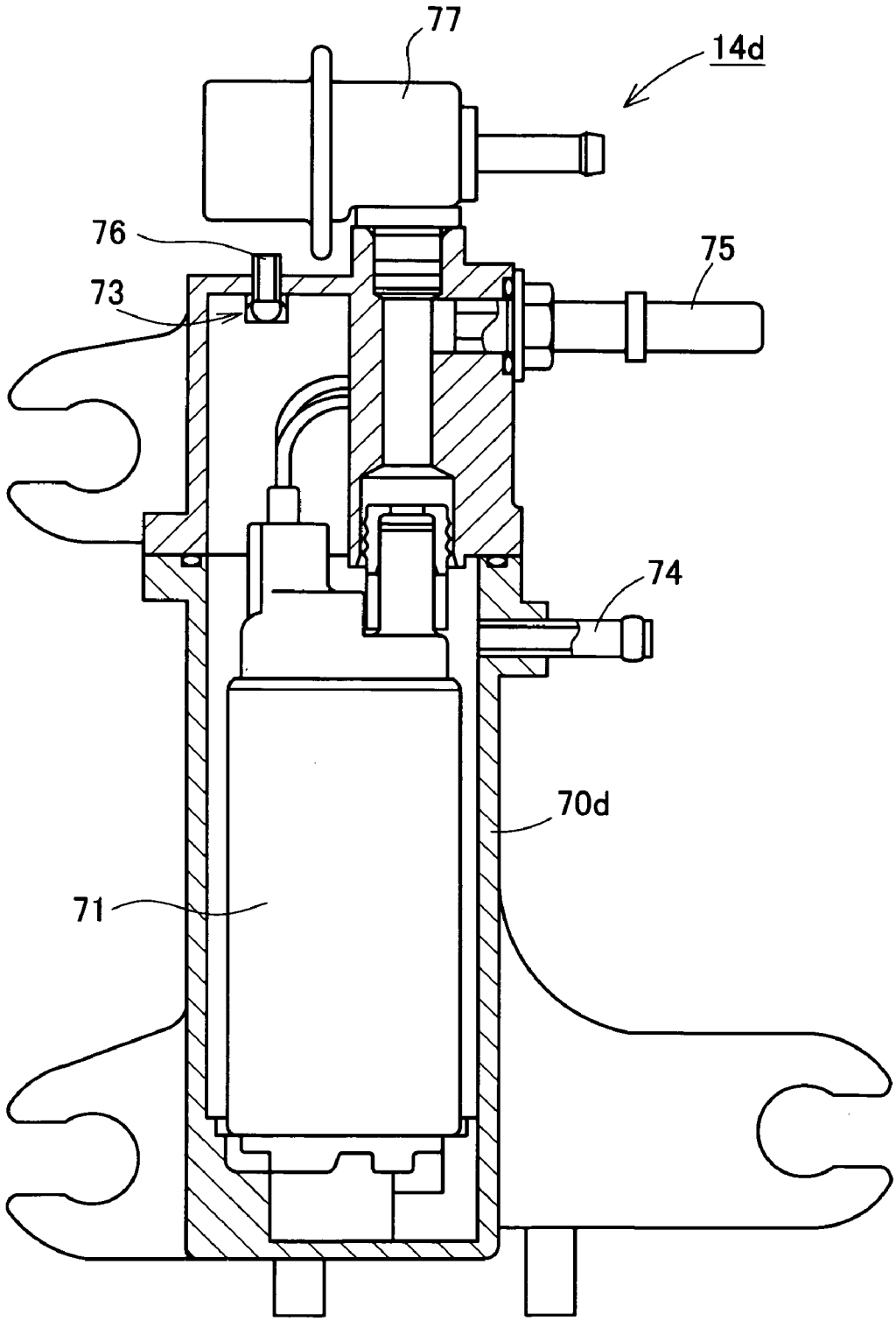
FIG. 18 is a sectional view of another modified form of the vapor separator.
Figure 19:
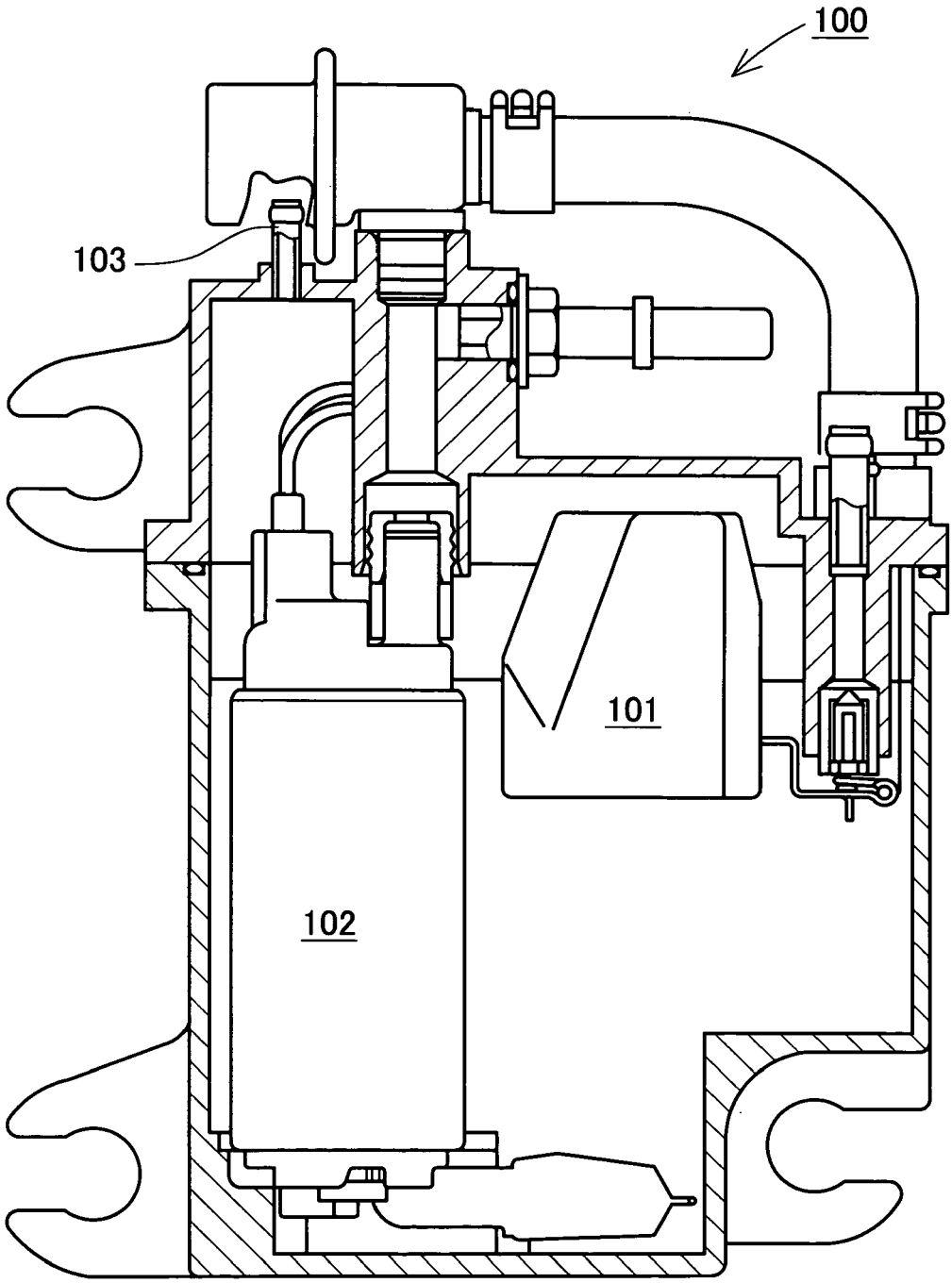
FIG. 19 PRIOR ART
FIG. 19 is a sectional view of a vapor separator in a prior art.

The present invention may be embodied in other specific forms without departing from the spirit or essential characteristics thereof. For instance, a vapor separator 14*d* shown in FIG. 18 may be used, which is configured to have a smaller width than the widths of the vapor separators 14, 14*a* used in the above embodiment and the modified form. This vapor separator 14*d* is substantially equal in width to the high-pressure fuel pump 71. Thus, a reduction in the size of a vapor separator can be achieved.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A fuel supply apparatus in an outboard engine provided with a fuel injection system, for supplying fuel from a fuel tank to an injector of the outboard engine, the apparatus comprising:

a low-pressure pump for sucking the fuel from the fuel tank;

a vapor separator for temporarily storing therein the fuel sucked by the low-pressure pump from the fuel tank; and a fuel pump located in the vapor separator and for supplying the fuel from the vapor separator to the injector of the outboard engine while pressuring the fuel;

wherein the low-pressure pump is used to fill the fuel into the vapor separator entirely and pressurize the fuel filled in the vapor separator at a predetermined pressure value or more.

2. The fuel supply apparatus according to claim 1, wherein the predetermined pressure value is 30 kPa.

3. The fuel supply apparatus according to claim 1, wherein a discharge pressure of the low-pressure pump in a shutoff state is set at 70 kPa or more.

4. The fuel supply apparatus according to claim 1, wherein the vapor separator is provided, at an upper part, with an air vent port through which air is released to the outside when the fuel is fed into the vapor separator, and a closing mechanism for closing the air vent port in association with a rise in fluid level of the fuel.

5. The fuel supply apparatus according to claim 4, wherein the closing mechanism is provided with a valve structure for tightly closing the vapor separator.

6. A vapor separator for temporarily storing therein fuel sucked and fed by a low-pressure pump from a fuel tank, wherein the low-pressure pump is adapted to fill the fuel into the vapor separator entirely and increase pressure of the fuel filled in the vapor separator.

7. A vapor separator which temporarily stores therein fuel sucked and fed by a low-temperature pump from a fuel tank, the vapor separator comprising:

pressurizing means for filling the fuel into the vapor separator and increasing the pressure of the fuel filled in the vapor separator;

a fuel pump located in the vapor separator for discharging the fuel having been pressurized by the pressurizing means while further pressurizing the fuel to supply the further pressurized fuel to an injector of an outboard engine; and a return pipe for returning return fuel from the fuel pump to a place upstream of the low-pressure pump.

8. A vapor separator which temporarily stores therein fuel sucked and fed by a low-temperature pump from a fuel tank, the vapor separator comprising:

pressurizing means for filling the fuel into the vapor separator and increasing the pressure of the fuel filled in the vapor separator;

a fuel pump located in the vapor separator for discharging the fuel having been pressurized by the pressurizing means while further pressurizing the fuel to supply the further pressurized fuel to an injector of an outboard engine;

a fuel pressure sensor for detecting pressure of the fuel discharged from the fuel pump; and pump control means for controlling the fuel pump based on the fuel pressure detected by the fuel pressure sensor so that the pressure of the fuel discharged from the fuel pump reaches a target fuel pressure.

9. The vapor separator according to claim 6, wherein the pressurizing means pressurizes the fuel filled in the vapor separator at 30 kPa or more.

10. The vapor separator according to claim 7, wherein the pressurizing means pressurizes the fuel filled in the vapor separator at 30 kPa or more.

11. The vapor separator according to claim 8, wherein the pressurizing means pressurizes the fuel filled in the vapor separator at 30 kPa or more.

12. The vapor separator according to claim 7, wherein the pressurizing means is a low-pressure pump for sucking the fuel from the fuel tank.

13. The vapor separator according to claim 8, wherein the pressurizing means is a low-pressure pump for sucking the fuel from the fuel tank.

14. The vapor separator according to claim 6 further comprising:

an air vent port through which air is released to the outside when the fuel is fed into an upper area of the vapor separator; and a closing mechanism for closing the air vent port in association with a rise in fluid level of the fuel.

15. The vapor separator according to claim 7 further comprising:

an air vent port through which air is released to the outside when the fuel is fed into an upper area of the vapor separator; and a closing mechanism for closing the air vent port in association with a rise in fluid level of the fuel.

16. The vapor separator according to claim 8 further comprising:

an air vent port through which air is released to the outside when the fuel is fed into an upper area of the vapor separator; and a closing mechanism for closing the air vent port in association with a rise in fluid level of the fuel.

17. The vapor separator according to claim 14, wherein the closing mechanism is provided with a valve structure for tightly closing the vapor separator.

18. The vapor separator according to claim 15, wherein the closing mechanism is provided with a valve structure for tightly closing the vapor separator.

19. The vapor separator according to claim 16, wherein the closing mechanism is provided with a valve structure for tightly closing the vapor separator.

20. The vapor separator according to claim 14, wherein the closing mechanism comprises:

a float valve which moves up and down according to an amount of fuel; and a float valve guide for guiding up-and-down movements of the float valve without tilting.

21. The vapor separator according to claim 15, wherein the closing mechanism comprises:

a float valve which moves up and down according to an amount of fuel; and a float valve guide for guiding up-and-down movements of the float valve without tilting.

22. The vapor separator according to claim 16, wherein the closing mechanism comprises:

a float valve which moves up and down according to an amount of fuel; and a float valve guide for guiding up-and-down movements of the float valve without tilting.

23. The vapor separator according to claim 14, wherein a closing position of the air vent hole is disposed lower than an uppermost part of the casing so that an air layer is formed in an upper area of the casing of the vapor separator.

24. The vapor separator according to claim 15, wherein a closing position of the air vent hole is disposed lower than an uppermost part of the casing so that an air layer is formed in an upper area of the casing of the vapor separator.

25. The vapor separator according to claim 16, wherein a closing position of the air vent hole is disposed lower than an uppermost part of the casing so that an air layer is formed in an upper area of the casing of the vapor separator.

26. The vapor separator according to claim 14 further comprising a fuel pipe which allows the fuel discharged from the low-pressure pump to flow into the vapor separator, the fuel pipe having an open end opening into the casing at a lower position than the closing position of the air vent hole.

27. The vapor separator according to claim 15 further comprising a fuel pipe which allows the fuel discharged from the low-pressure pump to flow into the vapor separator, the fuel pipe having an open end opening into the casing at a lower position than the closing position of the air vent hole.

28. The vapor separator according to claim 16 further comprising a fuel pipe which allows the fuel discharged from the low-pressure pump to flow into the vapor separator, the fuel pipe having an open end opening into the casing at a lower position than the closing position of the air vent hole.

29. The vapor separator according to claim 8 further comprising a relief valve which opens when the pressure of the fuel discharged from the fuel pump reaches a predetermined value or more.

30. The vapor separator according to claim 8 further comprising a fuel cooler for cooling the fuel supplied from the low-pressure pump.

31. The vapor separator according to claim 8 further comprising a branch pipe having a first end connected to a fuel pipe placed on a high-pressure side and a second end connected to the vapor separator, the branch pipe including a restriction whereby a sectional area of the branch pipe is reduced, and a fuel cooler for cooling the fuel which passes through the branch pipe.

32. The vapor separator according to claim 6 further comprising a relief valve which opens when the pressure of the fuel in a part on a low pressure side reaches a predetermined value or more.

33. The vapor separator according to claim 7 further comprising a relief valve which opens when the pressure of the fuel in a part on a low pressure side reaches a predetermined value or more.

34. The vapor separator according to claim 8 further comprising a relief valve which opens when the pressure of the fuel in a part on a low pressure side reaches a predetermined value or more.

* * * * *